US007959369B2

(12) United States Patent
Gueret

(10) Patent No.: US 7,959,369 B2
(45) Date of Patent: Jun. 14, 2011

(54) COSMETIC OR DERMATOLOGICAL TREATMENT METHOD AND DEVICES FOR APPLICATION OF SUCH A METHOD

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 1219 days.

(21) Appl. No.: 11/609,247

(22) Filed: Dec. 11, 2006

(65) Prior Publication Data

US 2007/0186951 A1 Aug. 16, 2007

Related U.S. Application Data

(60) Provisional application No. 60/754,610, filed on Dec. 30, 2005.

(30) Foreign Application Priority Data

Dec. 9, 2005 (FR) ..... 05 53823

(51) Int. Cl.
*A46B 11/00* (2006.01)

(52) U.S. Cl. ..... 401/123; 401/1

(58) Field of Classification Search ..... 401/1, 2, 401/208, 219, 261, 263, 265, 266, 123
See application file for complete search history.

(56) References Cited

U.S. PATENT DOCUMENTS

| | | | | |
|---|---|---|---|---|
| 2,472,385 | A | 6/1949 | Rollman | |
| 3,752,155 | A | 8/1973 | Blinoff, Jr. et al. | |
| 4,150,904 | A * | 4/1979 | Stewart | 401/186 |
| 4,537,194 | A | 8/1985 | Hanson et al. | |
| 4,745,909 | A | 5/1988 | Pelton et al. | |
| 5,127,395 | A | 7/1992 | Bontemps | |
| 2003/0100936 | A1 | 5/2003 | Altshuler et al. | |

FOREIGN PATENT DOCUMENTS

| | | |
|---|---|---|
| WO | WO 03/055425 | 7/2003 |
| WO | WO 2004/071362 | 8/2004 |

OTHER PUBLICATIONS

U.S Appl. No. 11/609,198, filed Dec. 11, 2006, Gueret.

* cited by examiner

*Primary Examiner* — David J Walczak
(74) *Attorney, Agent, or Firm* — Oblon, Spivak, McClelland, Maier & Neustadt, L.L.P.

(57) ABSTRACT

A device, applicator and a cosmetic non-therapeutic method of treating at least one area of the human body. The device includes a composition held in a container or a substrate and an applicator configured to apply the composition. The applicator includes an application surface that includes an application surface material with at least one of a thermal inertia of at least 1,000 $Jm^{-2}K^{-1}s^{-1/2}$ and a thermal conductivity greater than or equal to 1 $Wm^{-1}K^{-1}$. The method includes providing an applicator, cooling the applicator to a temperature below or equal to 15° C., and loading the cooled applicator with a cosmetic composition at a temperature closer to an ambient temperature than that of the applicator, and applying the composition using the applicator, or before or after the cooling, applying a cosmetic composition, and after the cooling, bringing the cooled applicator into contact with the area to be treated.

70 Claims, 12 Drawing Sheets

FIG. 18
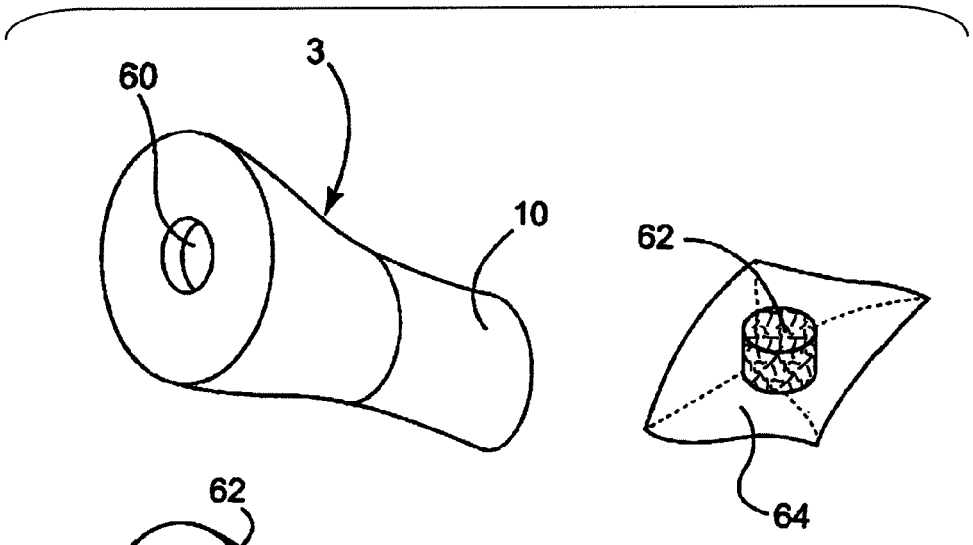
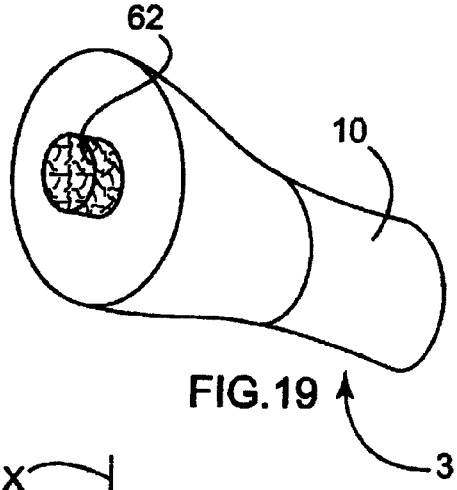
FIG.19
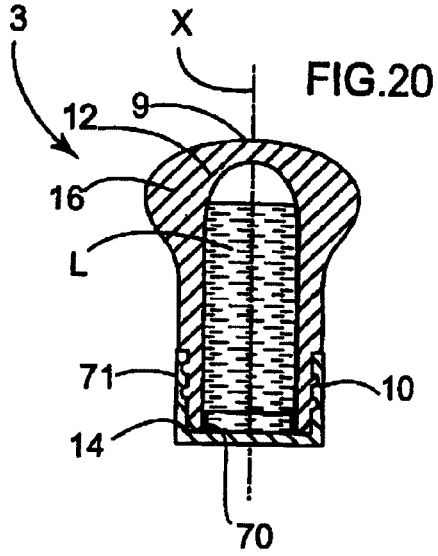
FIG.20
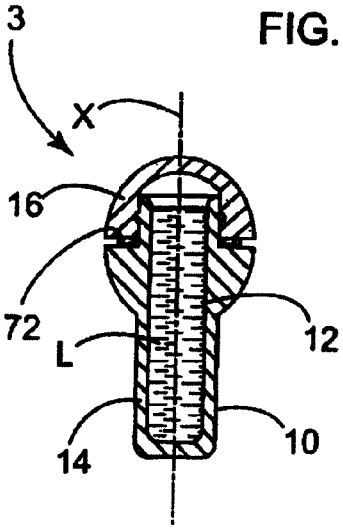
FIG.21
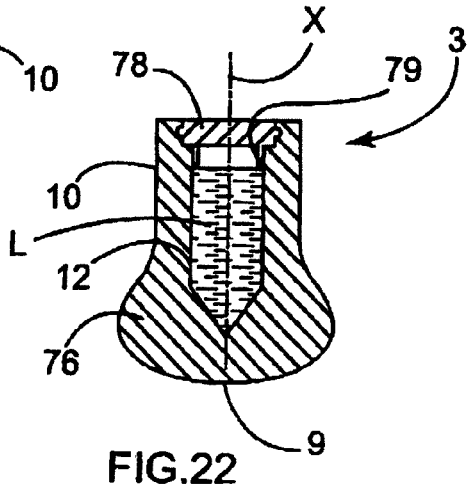
FIG.22
FIG.60
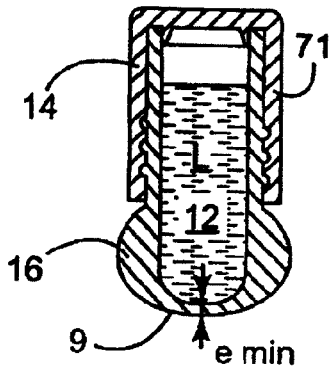

FIG.23
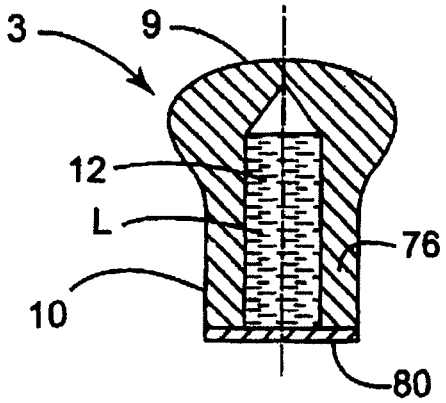
FIG.24
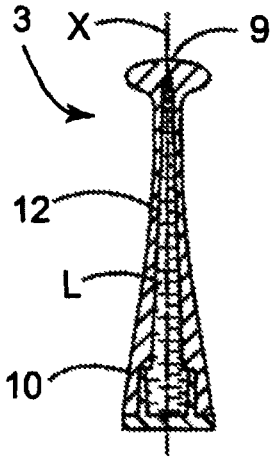
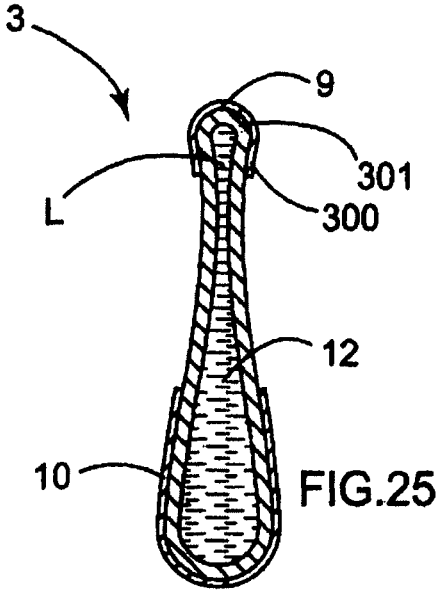
FIG.25
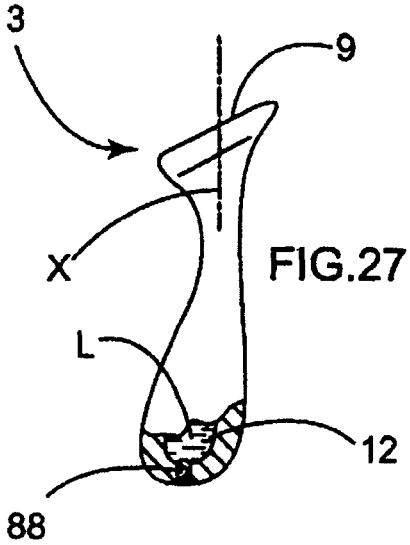
FIG.27
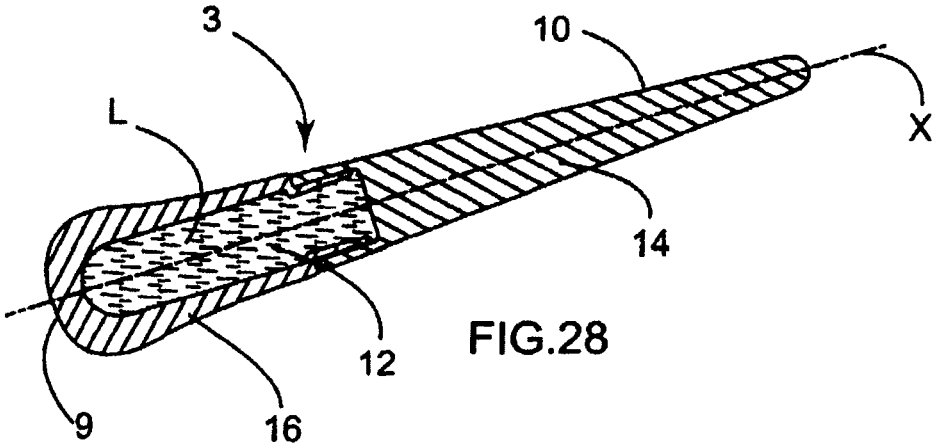
FIG.28

FIG.36
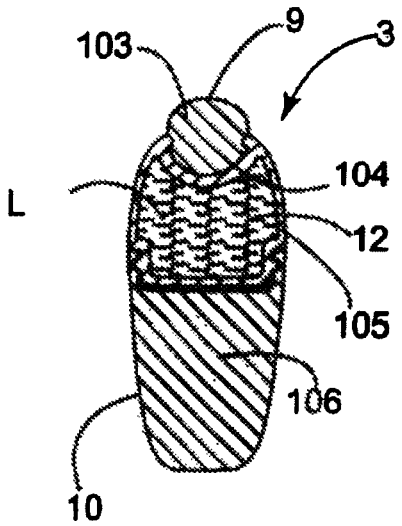
FIG.61
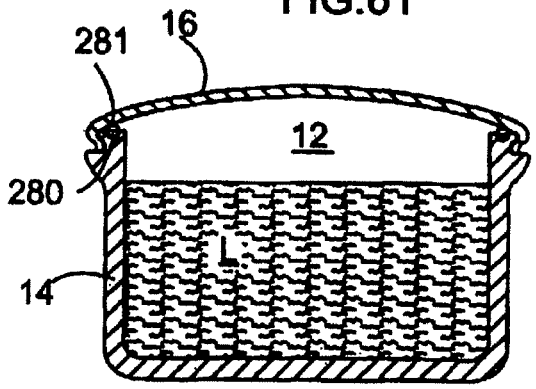
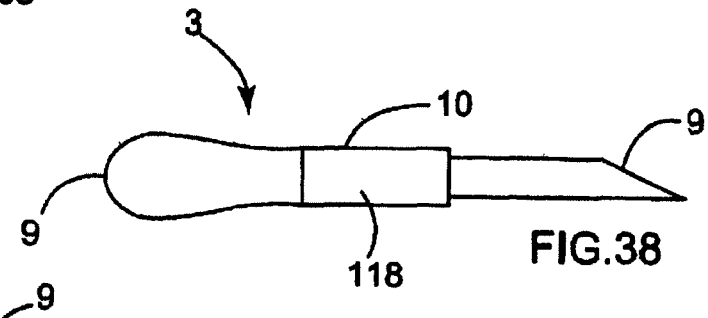
FIG.38
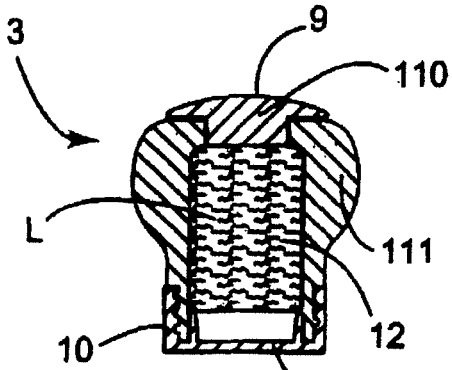
FIG.37
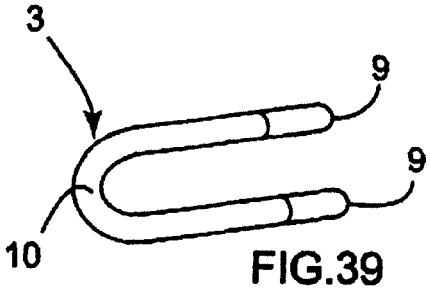
FIG.39
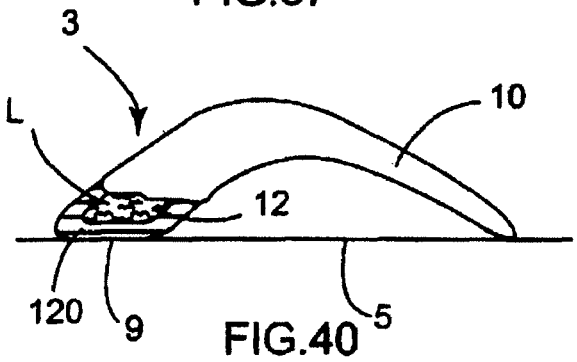
FIG.40
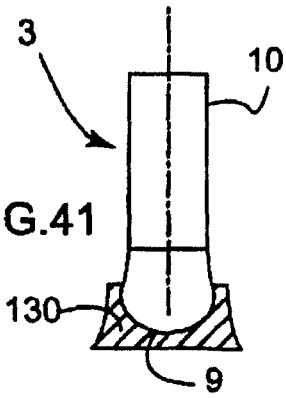
FIG.41

FIG.47
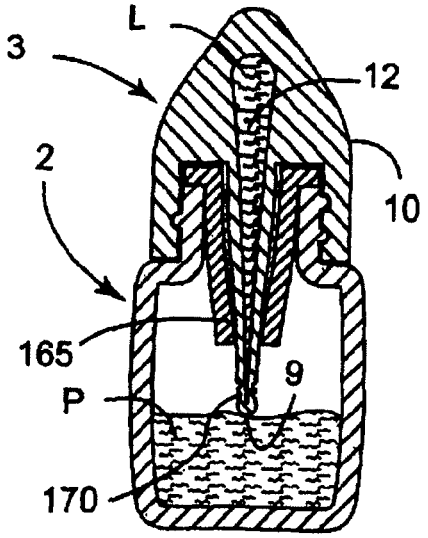
FIG.48
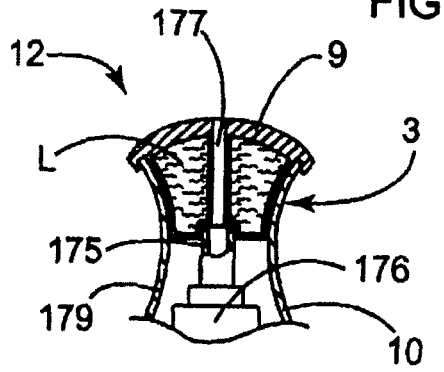
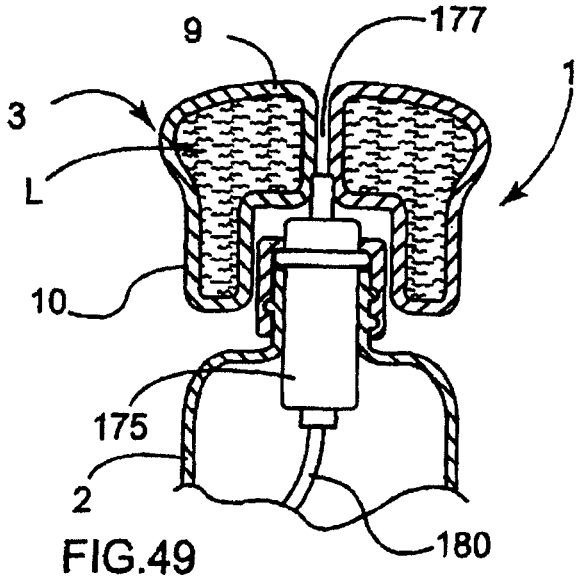
FIG.49
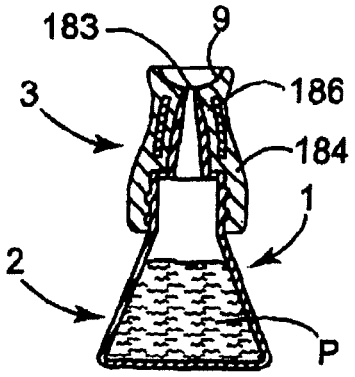
FIG.50
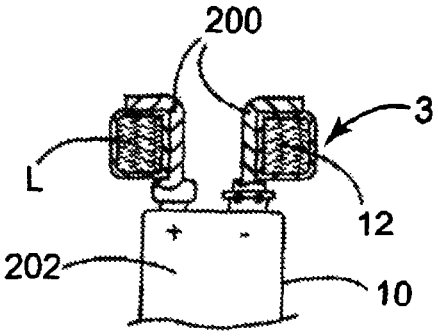
FIG.52
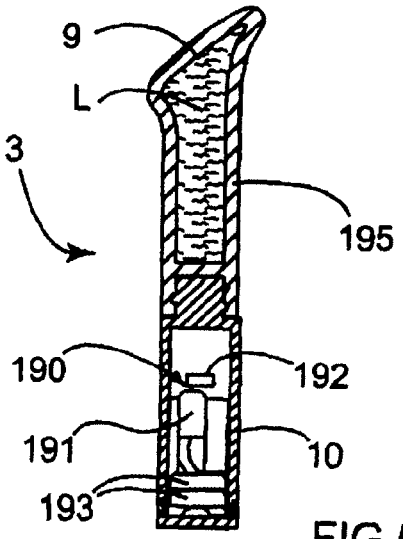
FIG.51

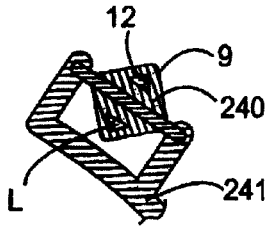
FIG.55
FIG. 54
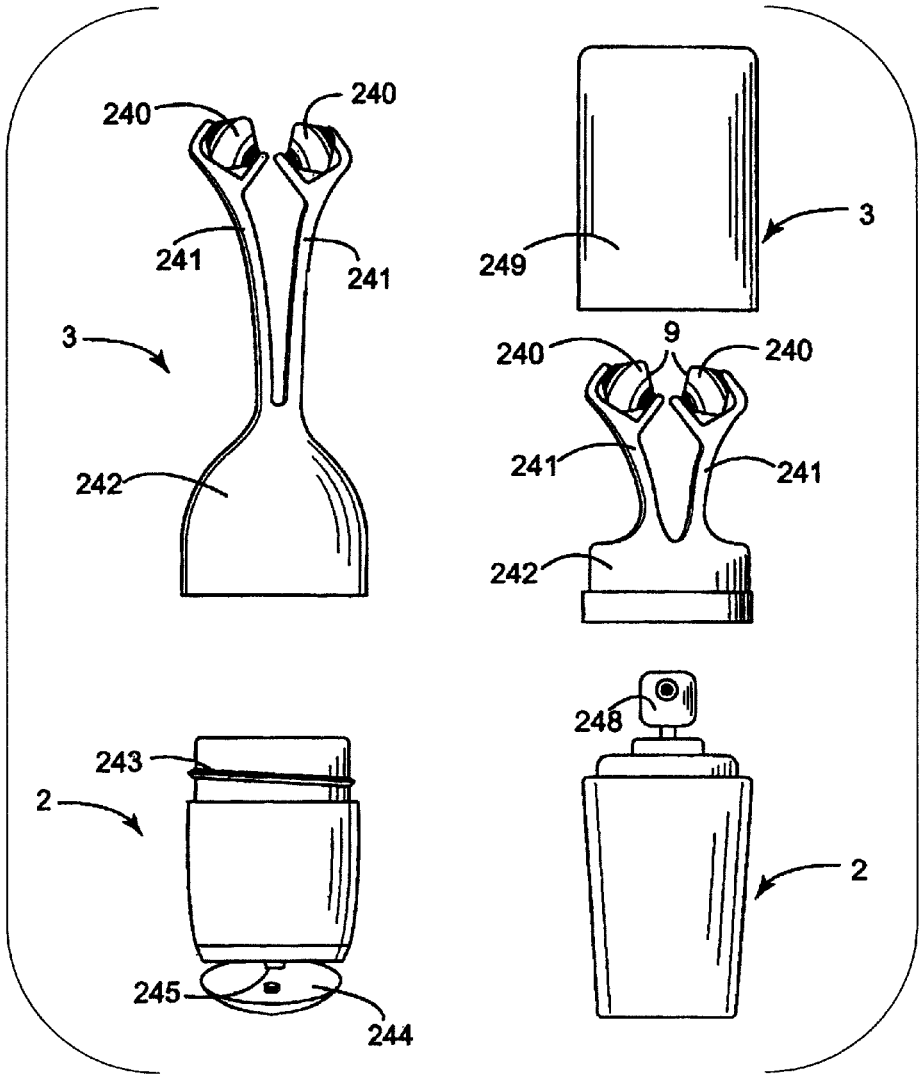
FIG. 56

COSMETIC OR DERMATOLOGICAL TREATMENT METHOD AND DEVICES FOR APPLICATION OF SUCH A METHOD

CROSS-REFERENCE TO RELATED APPLICATIONS

This document claims priority to French Application Number 0553823, filed Dec. 9, 2005 and U.S. Provisional Application No. 60/754,610, filed Dec. 30, 2005, the entire contents of each of which are hereby incorporated by reference herein.

FIELD OF THE INVENTION

The present invention concerns the cosmetic or dermatological treatment of the skin with the application of cold temperatures, or the treatment of keratinous materials such as the hair, for example.

BACKGROUND OF THE INVENTION

Discussion of Background

Conventional masks are available that can be placed in the refrigerator so as to facilitate the application of cold temperatures onto the face. Examples of such masks are marketed under the brand name COLDHOT® by the company 3M.

Application WO 2004/071362 describes a mask for the eyelids including an absorbent polymer which is cooled before application.

Application WO 03/055425 describes a cooling device incorporating polymer particles capable of absorbing water and enabling them to evaporate. Such an article is not designed to apply a cosmetic composition nor to massage the skin.

U.S. Pat. No. 4,745,909 describes a device intended to perform cooling which comprises a material such as water contained in a metal envelope of constant thickness. An insulating sleeve is fixed on part of the metal envelope to grip the device.

U.S. Pat. No. 5,127,395 describes a device intended to perform cooling which comprises a polyethylene sphere containing a mixture able to maintain a temperature of −20° C.

U.S. Pat. No. 4,537,194 describes a mold gripped by plastic that forms ice flows.

U.S. Patent Publication No. 2003/0100936 describes a roller which can be filled up with a liquid capable of storing heat.

These devices are not associated with a container containing a cosmetic product.

A packaging device capable of cooling a cream to a temperature of around 2° C. by mixing two components that react together has also been proposed. Such a packaging device is relatively complex and expensive, being in addition confined to a single use.

One conventional device places an application device containing a massage composition and an applicator ball in the refrigerator before use. The applicator ball cannot be used to massage the skin without also dispensing the massage composition.

U.S. Pat. No. 4,537,194 describes an applicator designed to apply a composition in the frozen state in order to treat a wound. The applicator includes a container which can serve as a grasping element once the composition has frozen.

The possibility of placing a cosmetic composition in the refrigerator or freezer before application does pose certain formulation problems.

In fact, certain cosmetic compositions are liable to solidify and/or become altered when cooled, for example, to a temperature below or equal to 0° C.

Furthermore, when a small quantity of composition is used locally, the cooling effect is of short duration due to warming of the composition in contact with the skin.

Moreover, certain dispensing devices are designed to operate with compositions having particular rheological properties and may no longer work properly when the viscosity of the composition is modified following a change of temperature.

There is therefore a need to be able to enjoy the benefit of a sustained cooling effect during the application of a cosmetic or dermatological composition without being faced with the drawbacks of known methods and devices.

SUMMARY OF THE INVENTION

It is an object of one example of the present invention to propose a treatment method, in particular a cosmetic treatment method, that enables the use of cold temperatures that are compatible with a wide range of cosmetic compositions.

The present invention thus concerns, in one of its aspects, a method of treating at least one area of the human body. The method in this aspect includes providing an applicator including an application surface that includes a material with a thermal conductivity greater than or equal to 1 $Wm^{-1}K^{-1}$, a grasping surface that includes a material with a thermal conductivity less than or equal to 1 $Wm^{-1}K^{-1}$, and a cavity inside the applicator, containing at least 0.2 ml of a liquid. The method in this aspect also includes cooling the applicator to a temperature below or equal to 15° C. and one of loading the cooled applicator with a cosmetic composition at a temperature closer to an ambient temperature than that of the applicator, and applying the composition using the applicator; and, before or after the cooling, applying at least one cosmetic composition on the at least one area of the human body, and after the cooling, bringing the cooled applicator into contact with the at least one area of the human body.

The composition is, for example, applied on the skin just before bringing the applicator into contact therewith. The composition can also have been applied more than an hour previously, or even the day before, for example, depending on the treatment to be carried out.

The invention can be used to treat an area of the human body with the application of cold by means of a cosmetic composition which can be of any type given that it is only cooled at the time of use.

When the composition is taken up from a container, the risk of denaturation due to cooling of the unused composition remaining in the container can thus be reduced.

The applicator can be used, inter alia, as a massaging implement or to perform cryopuncture. The applicator can be used in a beauty salon, at a point of sale, in a dermatologist's or doctor's practice, or at home, for example, first thing in the morning or last thing at night.

The uninterrupted contact time of the applicator on the skin or the hair is, for example, between 0.5 seconds and 30 minutes.

The duration of a treatment session is, for example, between 15 seconds and 1 hour, or more.

The application of a cold applicator can boost the action of a cosmetic or dermatological composition, for example, by preparing the skin for the action of the composition, by stimulating the circulation and/or by promoting the penetration of the active agents. The applicator can impart a relaxing effect. The action imparted can be intended, inter alia, to smooth, tone or firm the skin, reduce bags under the eyes, and/or reduce wrinkles.

Given that the applicator can be brought into contact with the treated area without necessarily dispensing composition onto the treated area at the same time, the applicator can be used to impart a massaging action with reduced risk of dispensing excess composition onto the treated area.

The temperature of the applicator can be less than or equal to 8° C., or less than or equal to 0° C. The applicator is, for example, initially cooled to a temperature between −18° C. and 0° C., for example, around −6° C. to −4° C.

The applicator can include a cavity, which can contain at least one compound capable of changing state when cooled to a low temperature. The applicator can be cooled to a temperature sufficiently low to produce this change of state. This compound can be a liquid which freezes when cooled. This liquid can include water. The change of state provides a means of maintaining a low temperature by virtue of the latent heat of melting of ice. The liquid can include an additive to lower its freezing point, for example, sodium chloride or an alcohol, for example, glycol.

The internal surface of the wall delimiting the cavity can be covered with a varnish.

The area to be treated can be the skin of the face or other parts of the body, including the mucous membranes, or the hair. The applicator can optionally serve, when brought into contact with the hair, to eliminate electrostatic charges. In particular, the applicator can serve to eliminate or reduce electrostatic charges when the application surface includes an electrically conductive material, for example, metallic.

In one example of the invention, the method includes the application on the area to be treated of a substrate carrying the composition, the applicator being brought into contact with the substrate thus applied. The substrate can include a woven, a non-woven, or a foam material.

The cosmetic composition can be taken up from a container to be applied on the area to be treated. The composition can be taken up by means of the applicator or by other means, for example, using a finger or a spatula or a dispensing device such as a pump. The container can include a dispensing nozzle.

The applicator can be cooled by being placed in a refrigerator or freezer or by being exposed to the expansion of a compressed or liquefied gas or to an endothermic reaction. The applicator can also be used at ambient temperature if the user so wishes, or at hot temperatures. The composition can be held in a container that is closed when the applicator is in use.

An example of another aspect of the present invention is a device including, optionally, a cosmetic or dermatological composition held in a container or substrate, an applicator capable of being separated from the container or substrate and including an application surface to treat an area of skin.

The applicator in this example includes at least one material having a thermal behavior such that, when the applicator is cooled to a low temperature that does not cause thermal damage to the skin when the application surface of the applicator remains in contact with the skin for 15 seconds, the application surface is capable of retaining, after this period of skin contact of at least 15 seconds, a temperature below 15° C.

The device can include solely an applicator in the absence of a composition.

In one example of the invention, the temperature of the application surface can be measured using a contactless thermometer.

An example of another aspect of the present invention is a device including, a composition held in a container or a substrate and an applicator configured to apply the composition. In this example, the applicator includes an application surface that includes an application surface material with at least one of a thermal inertia of at least 1,000 $Jm^{-2}K^{-1}s^{-1/2}$, and a thermal conductivity greater than or equal to 1 $Wm^{-1}K^{-1}$. The applicator and the container or the substrate are contained in a common packaging device in this example.

An example of another aspect of the present invention is a device including, optionally, a cosmetic or dermatological composition held in a container or substrate and an applicator configured to apply the composition, the applicator including an application surface that includes an application surface material with a thermal inertia of at least 1,000 $Jm^{-2}K^{-1}s^{-1/2}$. The device according to this example can include an application surface material with a thermal inertia of preferably at least 5,000 $Jm\,K^{-1}s^{-1/2}$, even more preferably at least 10,000 $Jm^{-2}K^{-1}s^{-1/2}$, preferably at least 20,000 $Jm^{-2}K^{-1}s^{-1/2}$. The applicator and the container or the substrate are contained in a common packaging device in this example.

Thermal inertia characterizes the ability of the application surface to retain a low temperature when periodically exposed to an addition of heat on contact with the skin.

Thermal inertia is defined by the formula $(k*p*C)^{1/2}$, where k is the thermal conductivity, p the volume density, and C the specific heat capacity.

For example, aluminum has the values (in SI units): p=2702, k=238 and C=900, giving a thermal inertia of around 24,000 $Jm^{-2}K^{-1}s^{-1/2}$.

A relatively high thermal inertia enables the application surface to retain a relatively low temperature despite repeated contact with the skin.

An example of another aspect of the present invention is a device that includes a composition held in a container or a substrate and an applicator configured to apply the composition, the applicator including an application surface that includes an application surface material with a thermal conductivity greater than or equal to 1 $Wm^{-1}K^{-1}$.

The composition in this example can be a cosmetic or dermatological composition, and the applicator and the container or the substrate can be contained in a common packaging device.

The device in this example can include an application surface that includes an application surface material with a thermal conductivity preferably greater than or equal to 40 $Wm^{-1}K^{-1}$, and even more preferably 180 $Wm^{-1}K^{-1}$.

A high thermal conductivity is conducive to the transfer of cold temperatures between the applicator and the area to be treated and facilitates rapid renewal of cold temperatures as long as the cold temperatures maintained by the applicator permits.

The characteristic of a specified thermal conductivity can be advantageously combined with a specified thermal inertia within the same applicator.

The composition and the applicator can be contained initially in the same packaging.

The container and the applicator can be contained initially in the same packaging.

The applicator and the container can be contained in a common packaging device, for example, a box, a carton pack, a blister pack, a film pack or a sachet.

An example of another aspect of the present invention is a device including, optionally, a cosmetic or dermatological composition held in a container or substrate, an applicator including an application surface and at least one cavity containing at least one compound, for example, liquid, optionally capable of changing state when cooled from ambient temperature to a temperature not below −18° C., for example, to a temperature between −18° C. and 0° C. The compound is, for example, a liquid, such as a liquid containing water.

An example of another aspect of the present invention is an applicator including an application surface that includes a material with a thermal conductivity greater than or equal to 1 $Wm^{-1}K^{-1}$, a grasping surface that includes a material with a thermal conductivity less than or equal to 1 $Wm^{-1}K^{-1}$, and a cavity inside the applicator, containing at least 0.2 ml of a liquid.

The application surface according to this example can include a material with a thermal conductivity preferably greater than or equal 40 $Wm^{-1}K^{-1}$, and even more preferably 180 $Wm^{-1}K^{-1}$.

The grasping surface according to this example can include a material with a thermal conductivity preferably less than or equal to 0.5 $Wm^{-1}K^{-1}$, and even more preferably 0.1 $Wm^{-1}K^{-1}$.

An example of another aspect of the present invention is an applicator including an application surface that includes a material with a thermal conductivity greater than or equal to 1 $Wm^{-1}K^{-1}$, preferably 40 $Wm^{-1}K^{-1}$, even more preferably 180 $Wm^{-1}K^{-1}$, a grasping surface including a material having a thermal conductivity less than or equal to 1 $Wm^{-1}K^{-1}$, preferably 0.5 $Wm^{-1}K^{-1}$, even more preferably 0.1 $Wm^{-1}K^{-1}$, and a cavity inside the applicator, containing a liquid, the cavity being defined by a wall having a non-constant thickness.

The applicator can include a metallic material at least partially defining the application surface that is intended to come into contact with the area to be treated. This material can include aluminium, optionally an alloy such as Zamak®. Other materials can be used, for example, stainless steel, copper and alloys thereof.

The applicator can also include materials that are non-metallic, but dense, for example, having a density greater than or equal to 1.1 $g/cm^3$, preferably 1.5 $g/cm^3$, even more preferably 2.5 $g/cm^3$. For example, sand, glass or kimberlite can be used.

The application surface can include a material having a density of at least 1.5 $g/cm^3$.

The application surface can include a non-metallic material, for example, glass.

As indicated above, the applicator can include a material in the application surface intended to come into contact with the area to be treated and having a thermal conductivity greater than or equal to 1 $Wm^{-1}K^{-1}$, preferably 40 $Wm^{-1}K^{-1}$, even more preferably greater than or equal to 180 $Wm^{-1}K^{-1}$. This material can be in contact with the liquid contained in the cavity referred to hereinbefore.

The applicator can include a material having specific heat capacity greater than or equal to 500 J $kg^{-1}K^{-1}$, preferably 1,000 J $kg^{-1}K^{-1}$, even more preferably 2,000 J $kg^{-1}K^{-1}$.

The thermal capacity of the applicator is, for example, such that at an ambient temperature of 20° C. the application surface retains a temperature below or equal to 15° C. for at least 10 minutes when initially cooled to −6° C.

The applicator can have a mass greater than or equal to 15 g including any liquid.

The applicator can include at least 0.2 $cm^3$ of liquid in the cavity, for example, between 1 $cm^3$ and 80 $cm^3$, in particular between 5 $cm^3$ and 70 $Cm^3$, for example, between 5 $cm^3$ and 15 $cm^3$, or between 5 $cm^3$ and 10 $cm^3$.

The applicator can include a grasping surface including a material having a thermal conductivity less than or equal to 1 $Wm^{-1}K^{-1}$, preferably 0.5 $Wm^{-1}K^{-1}$, even more preferably 0.1 $Wm^{-1}K^{-1}$, for example, a non-metallic or non-mineral material such as plastic or wood. The grasping surface can also be defined by a cellular material, for example, a foam.

The cavity can be partially defined by a material having a thermal conductivity greater than or equal to 1 $Wm^{-1}K^{-1}$, and partially defined by a material having a thermal conductivity less than or equal to 1 $Wm^{-1}K^{-1}$. The cavity can be partially defined by a metallic material and partially defined by plastic material.

Most of the cavity can be partially defined by a material having a thermal conductivity less than or equal to 1 $Wm^{-1}K^{-1}$.

The applicator can include at least one part which is molded, for example, by injection or blow molding, or which is machined. The cavity can be made by molding and/or by machining. The applicator can include more than one cavity containing the liquid capable of changing state. The applicator can include a metallic material and a plastic material, a glass and a metallic material, a glass and a plastic material, for example.

The application surface can be soft and polished or, as a variant, can include asperities or projections such as raised points. The projections can be chosen, for example, as a function of the cooling effect that it is desired when the applicator makes contact with the area to be treated. The projections can serve to reduce the extent of contact with the skin.

The application surface can be defined by a material that is hard or otherwise. The application surface can be defined at least partially by a wall at least partially covered by an elastomer membrane, a foam, a flock material, a plastic film, a sponge, a felt, a woven or non-woven material. The wall covered in this way is, for example, formed at least partially by a metallic material.

The application surface can have at least one area extending to between 3 and 10 $cm^2$, capable of coming wholly into contact with the skin and the thermal capacity of the applicator can be greater than or equal to 250 J $K^{-1}$ at a temperature of 15° C. The application surface may also include at least one area extending to between 0.1 and 3 $cm^2$ capable of coming wholly into contact with the skin and the thermal capacity of the applicator can be greater than or equal to 50 J $K^{-1}$ at a temperature of 15° C.

In one example of the invention, the applicator can be detachably fixed on the container holding the composition to be applied. The applicator can be detachably fixed on a closure element of the container. The container can include, for example, a cover having a recess into which the applicator can be inserted when not in use. The applicator can optionally serve as closure element for a container holding the composition.

The applicator can also be designed to be detachably fixed on a dispensing device enabling the composition to be taken up. The container can also include an extension having a recess capable of receiving the applicator.

The device can be configured to rest on a surface in a storage position so that the liquid is in contact with the wall delimiting the application surface.

The applicator can include a rotary applicator element configured to come into contact with the area to be treated or a plurality of rotary applicator elements, which can fold and move the skin during their passage, for example.

Further, the applicator can be at least partially magnetic. The applicator can include a flexible lip, for example, arranged in the manner of a suction cup. The applicator can include a passage enabling the composition to be dispensed when the applicator is mounted on the container. The composition can come into contact with this passage or the latter can receive a dispensing nozzle in which the composition circulates.

The applicator can include a vibrator and/or at least one electrode connected to a power source, for example, two electrodes between which a potential difference is established. The container can have an internal space configured to contain a variable volume of the composition.

The applicator can include an application surface that includes a detachable element. The latter includes, for example, an absorbent material and/or fibres, or bristles, and can, for example, be detached from the applicator to be washed. The detachable element can, for example, improve spreading of the composition on the area treated by means of the applicator.

The applicator can have a reduced thickness ($e_{min}$) between the aforementioned cavity and the application surface, less than or equal to 50 mm, preferably less than or equal to 10 mm, even more preferably less than or equal to 1 mm, for example, between 0.1 mm and 1 mm, for example, between 0.2 mm and 0.8 mm, so as to promote heat transfer between the application surface and the liquid contained in the cavity.

The applicator can include at least one temperature indicator, which works for example, by changing color. The temperature indicator can change color to warn the user that the application surface is at a temperature above or below a pre-set threshold, for example.

The applicator can include a take-up element for the composition held in the container. The take-up element can include, for example, a foam material, an agglomerate material, a felt material, a woven material, a non-woven material, a flock material or bristles. The take-up element can be located at an end of the applicator opposite the application surface.

The device can be configured, when cooled to −8° C. and applied on the skin, to retain for at least 30 seconds, preferably 1 minute, even more preferably 15 minutes or 30 minutes, a temperature below or equal to 15° C.

The applicator need not include compounds that react together by an endothermic reaction. Further, the applicator can be devoid of an electrical power source or means of connection to a power source.

The applicator can include a first part assembled with at least one second part, for example, by force fit, snap attachment, screwing, welding, gluing, over-molding or crimping.

The first part can define the application surface and can include a metallic material, for example. The second part can define the grasping surface and can include a non-metallic material. The first or the second part can include a filling aperture for the cavity containing the liquid. As a variant, the cavity can be filled before assembly of the first and second parts.

The container can include a first compartment containing the composition and a second compartment to receive the applicator and a closure element enabling the first and second compartments to be closed at the same time. The container can also include a central recess to at least partially receive the applicator.

The packaging and applicator device can include a first applicator configured to be cooled and a second applicator configured to be heated. The first applicator can contain a liquid and can include a metallic material and the second applicator can be devoid of metal so that it can be placed in a microwave oven.

An example of another aspect of the present invention is a device including, optionally, a cosmetic or dermatological composition, an applicator configured, when cooled to −8° C. and applied on the skin, to retain for at least 30 s, preferably 1 min, even more preferably 15 min or 30 min, a temperature below or equal to 15° C.

As should be apparent, the invention can provide a number of advantageous features and benefits. It is to be understood that, in practicing the invention, an embodiment can be constructed to include one or more features or benefits of embodiments, described herein, but not others. Accordingly, it is to be understood that the preferred embodiments discussed herein are provided as examples and are not to be construed as limiting, particularly since embodiments can be formed to practice the invention that do not include each of the features of the described examples.

BRIEF DESCRIPTION OF THE DRAWINGS

A better understanding of the invention will be gained from reading the following description in conjunction with the accompanying figures. The figures are offered purely as a guide and for purposes of example, and in no way limit the invention.

FIG. 18 is a schematic illustration of another example of a kit for putting the invention into effect;

FIG. 19 illustrates the applicator in FIG. 18 during use;

FIGS. 20 to 25, 27 to 29 and 60 are schematic longitudinal cross-sections of alternative embodiments of the applicator;

FIGS. 36 to 53 are schematic partial longitudinal cross-sections of alternative embodiments of the applicator;

FIG. 54 is perspective view of another example of a packaging and applicator device;

FIG. 55 is a schematic and partial cross-section of the applicator;

FIG. 56 is a view similar to FIG. 54 of an alternative embodiment; and

FIGS. 57 to 59 and 61-66 illustrate alternative embodiments of the invention.

DETAILED DESCRIPTION OF THE PREFERRED EMBODIMENTS

Figure 1:
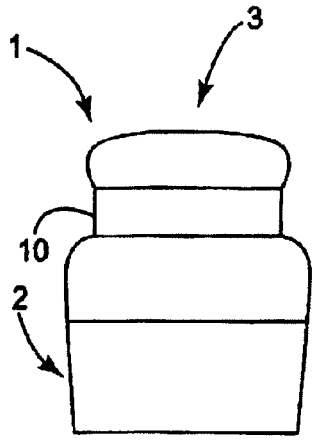
FIG. 1 illustrates an elevation of a device made according to one embodiment of the invention.

Referring now to the drawings, like reference numerals are utilized to designate identical or corresponding parts throughout the several views.

Figure 2:
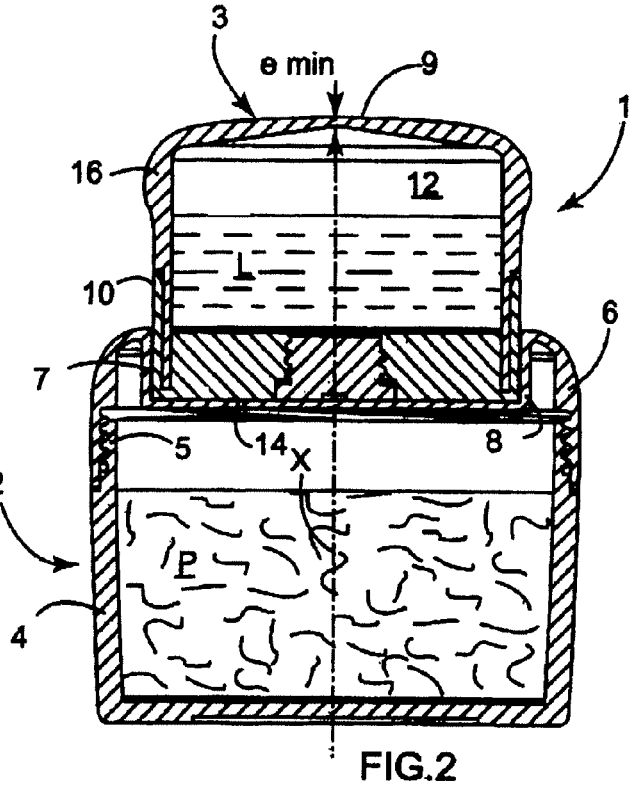
FIG. 2 is a schematic illustration of a longitudinal cross-section of the device in FIG. 1.

The packaging and applicator device 1 illustrated in FIGS. 1 and 2 includes a container 2 holding a composition P to be applied on the human body and an applicator 3, located on axis X, configured to be used during application of the composition P.

The composition P is intended to impart an action, for example, such as an anti-wrinkle, contouring, moisturising, colouring, anti-acne, anti-seborrheic, bleaching, stimulating, regenerating or soothing action, and/or to conceal skin blemishes.

The composition P is, for example, a cosmetic formulation such as defined in Directive 93/35/EEC of 14 Jun. 1993 amending Directive 76/768/EEC.

The composition P, for example, does not withstand prolonged storage in the container 2 at a temperature below or equal to 0° C.

In the example considered, the container 2 takes the form of a pot including a body 4 provided at the top with a threaded neck 5 and a cover 6 capable of being detachably fixed on the neck 5, for example, by screwing.

The cover 6 and the neck 5 can include sealing means enabling the container 2 to be closed in a leaktight manner.

The cover 6 includes an upper wall 8 defining a recess 7 open at the top, in which the applicator 3 can engage when not in use.

The applicator 3 is, for example, held by friction in the recess 7.

The applicator 3 has an application surface 9 configured to come into contact with the area to be treated, for example, the skin, and a grasping surface 10 configured to be grasped by the user so that it can be manipulated.

The application surface 9 is, for example, located on the side opposite the container 2 when the applicator 3 is received in the recess 7.

Figure 3:
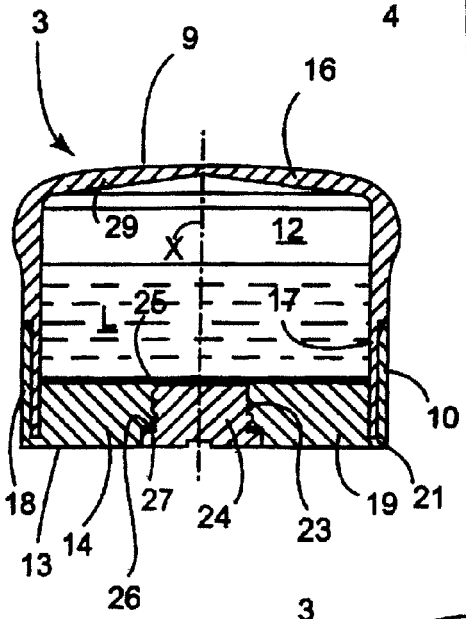
FIG. 3 separately illustrates the applicator in FIGS. 1 and 2.

The grasping surface 10 is, for example, a lateral surface extending from a lower face 13 of the applicator (as seen in FIG. 3), for example, over more than a third of the total height of the applicator, or, for example, over substantially half of its total height. In the example considered, the applicator 3 includes an internal cavity 12 which can contain a liquid L intended to maintain a cold temperature. A liquid L that changes state during cooling of the applicator 3 is advantageously chosen.

The liquid L can, for example, include water and can pass from a liquid state to a frozen state during cooling of the applicator 3 to a temperature below or equal to 0° C.

The quantity of liquid L ranges, for example, from 0.2 to 10 $cm^3$, depending on the amount of heat or cold that is desired to be stored.

The liquid can include a compound that lowers its freezing point. The liquid L can change state, for example, between −12° C. and 0° C. The volume of the cavity 12 can be greater than that of the liquid L so as to enable the latter to expand as it freezes.

The applicator is advantageously configured to be able to rest on a surface so that the liquid is in contact with the wall delimiting the application surface. For example, the application surface 9 can be substantially planar so as to be able to rest on a plane surface as one illustrated on FIG. 66. The applicator in this example can then be placed in the refrigerator between two uses in this position "head in bottom" position, so that the liquid remains in contact with the application surface 9.

In a variant not illustrated, the cavity 12 is filled with a powder, for example, sand.

In the example considered, as depicted in FIGS. 2 and 3, the internal cavity 12 is formed between a first part 16, which defines the application surface 9, and a second part 14 which defines the grasping surface 10. This second part 14 is typically assembled with the first.

The second part 14 includes, for example, an outer skirt 18 located on the axis X and covering an inner skirt 17 of the first part 16, and which connects to a transverse wall 19. The transverse wall 19 forms an annular groove 21 with the outer skirt 18 in which the inner skirt 17 engages. This can make it possible to obtain a leaktight assembly.

The second part 14 is advantageously made of a non-metallic material, for example, a plastic, so as to thermally insulate the grasping surface 10 of the cavity 12.

The second part 14 is, for example, made of a plastic having a thermal conductivity less than or equal to 1 $Wm^{-1}K^{-1}$, preferably less than or equal to 0.5 $Wm^{-1}K^{-1}$.

The second part 14 can include an opening 23 enabling the cavity 12 to be filled with the liquid L. This opening 23 is formed, for example, through the transverse wall 19, and it can be closed off by a plug 24.

The opening 23 has, for example, a threaded portion 25 and a shoulder 26. The plug 24 can be screwed into the threaded portion 25 and a leaktight seal 27 can be interposed between the plug 24 and the shoulder 26.

The first part 16 includes an upper wall 29 of which the thickness, measured on the axis X, can, for example, decrease towards the axis X so as to promote heat transfer between the cavity 12 and the application surface 9 in the central region of the applicator 3.

As seen in FIG. 2, the upper wall 29 presents, for example, on the axis X, a reduced thickness $e_{min}$ less than or equal to 1 mm, for example, in the order of 0.2 to 0.5 mm.

The first part 16 is, for example, made of a metal that is a good conductor of heat and has a relatively high thermal inertia, for example, aluminium or an aluminium alloy such as Zamak®. The cavity 12 can be closed in a leaktight manner other than by means of a fitted plug.

Figure 4:
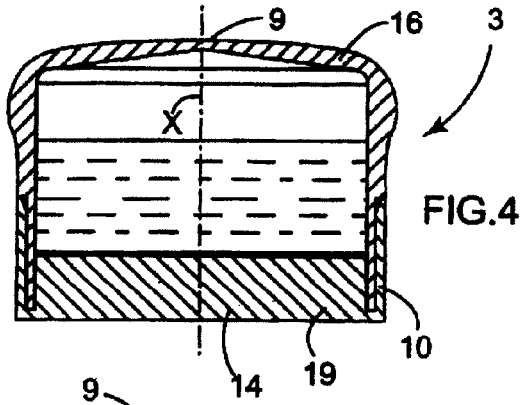
FIGS. 4 and 5 are views similar to FIG. 3 of alternative embodiments of the applicator.

In the variant illustrated in FIG. 4, the second part 14 does not include the opening 23, the first and second parts 16 and 14 being assembled, for example, after filling the cavity 12 with the liquid L and cooperating so as to close the cavity 12 in a leaktight manner.

Assembly of the first part 16 and the second part 14, in the examples shown in FIGS. 3 and 4, inter alia, can be carried out in different ways. For example, assembly can be carried out by force fit, gluing, snap attachment, welding, over-moulding, screwing, or crimping.

Figure 5:
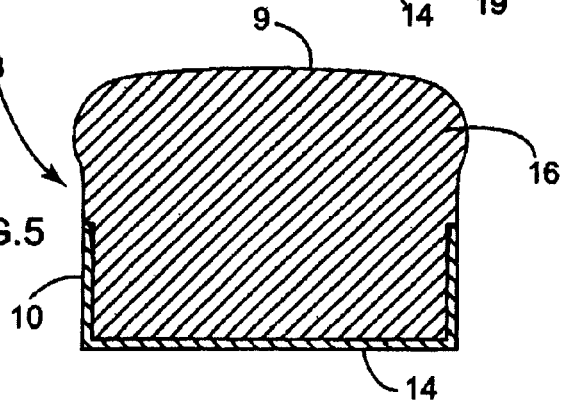

In the variant illustrated in FIG. 5, the applicator 3 does not include the cavity 12 filled with the liquid L.

The first part 16 is then, for example, solid and made of a material having sufficient thermal capacity and thermal conductivity to obtain the desired result. This material includes, for example, a metallic material, glass, dense stone or a loaded plastic.

The second part 14 can be effective in thermally insulating the grasping surface 10 and can be made of plastic or wood, for example.

Figure 65:
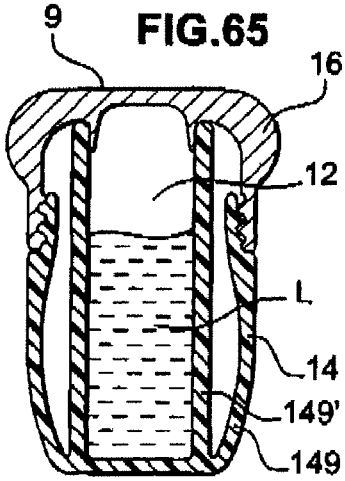

The second part 14 can also comprise a double wall 149, 149' as illustrated on FIG. 65. This double wall contributes to the thermally insulation of the grasping surface.

Figure 66:
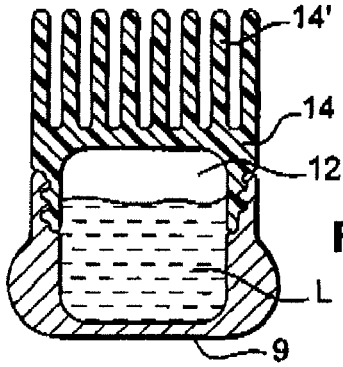

The second part 14 can also comprise wings 14', as illustrated on FIG. 66, which make it possible to reduce the capacity of the applicator while providing a good area for a user to grasp. In a variant not illustrated, the applicator 3 can also be made in one piece of a single material.

In the variant shown in FIG. 61, the first part 16 is formed, for example, from a stamped plate, for example, a metal plate, in particular aluminium.

The second part 14 is, for example, designed to enable the first part 16 to be fixed by snap attachment.

The second part 14 can include a groove 280 configured to receive a leaktight seal 281 bearing on the inner surface of the first part 16. The latter can be fixed on the second part 14 after filling the cavity 12 with the liquid L.

The applicator 3 can be made with a shape adapted to the area to be treated.

The applicators 3 depicted in FIGS. 1 to 5 are relatively wide, being for example, wider than their height, and are configured, for example, to treat an area of the body other than the face.

Figure 6:
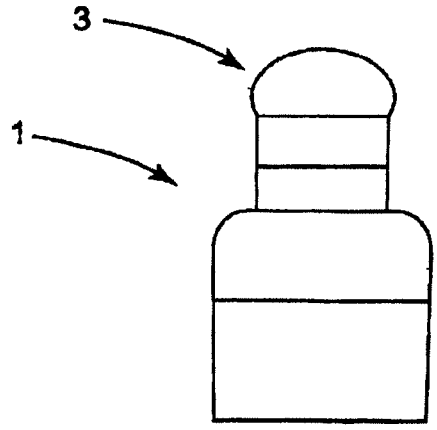
FIG. 6 is a view similar to FIG. 1 of an alternative embodiment of the device.
Figure 7:
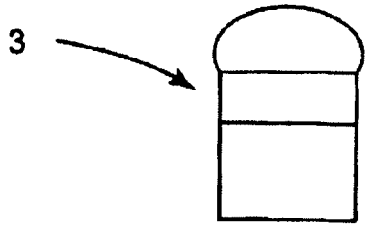
FIG. 7 separately illustrates an elevation of the applicator in FIG. 6.

FIG. 6 illustrates a packaging and applicator device 1 that includes a narrower applicator 3 that is better adapted to the face. As can be seen in FIG. 7, the height of this applicator 3 is greater than its width, for example.

The applicator shown in FIG. 4 contains, for example, 50 ml of water. The first part 16 is, for example, formed from 42.9 g aluminium and the second part 14 from 13.9 g of polyacetal (POM).

The thermal capacity of the applicator at 15° C., the water being liquid, is substantially $((50*10^{-3})*4185)+((13.9*10^{-3})*1460)+((42.9*10^{-3})*900)=268\ J\ K^{-1}$ and the latent heat of melting of ice $(50*10^{-1})*(3.34*10^{5})=16{,}700\ J$.

The applicator shown in FIG. 7 contains, for example, 9.5 ml of water. The first part 16 is, for example, formed from 15.1 g aluminium and the second part from 3.6 g of polyacetal (POM).

The thermal capacity of the applicator at 15° C., the water being liquid, is substantially $((9.5*10^{-1})*4185)+((3.6*10^{-3})*1460)+((15.1*10^{-3})*900)=58.6\ J\ K^{-1}$.

Figure 8:
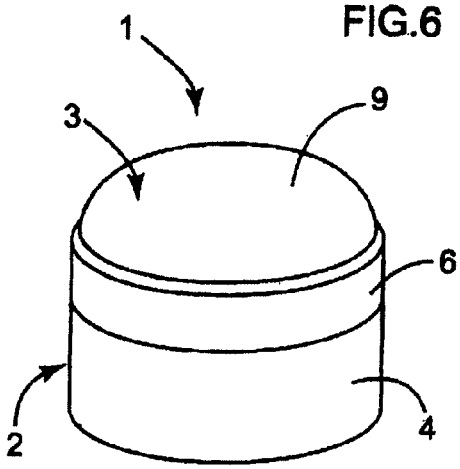
FIG. 8 is a perspective view of an alternative embodiment of the device.
Figure 9:
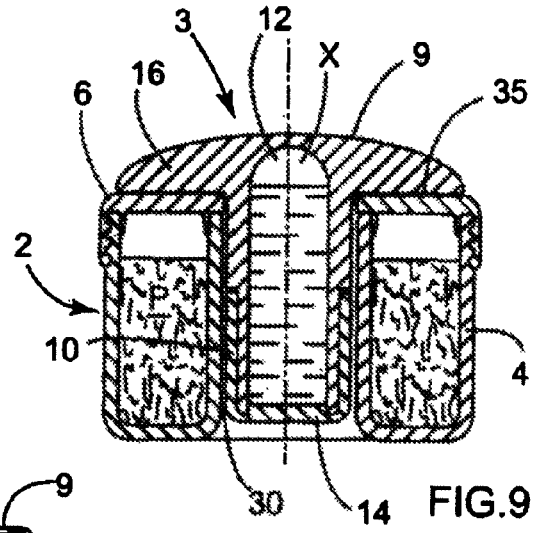
FIG. 9 is a longitudinal cross-section of the device in FIG. 8.

FIGS. 8 and 9 depict a device according to another example in which the container 2 has a central recess 30 in which the applicator 3 can at least partially engage.

The recess 30 typically extends fully through container 2, for example, as illustrated.

The applicator 3 is, for example, configured to be supported by a bearing surface 35 on the top of the cover of the container 2. In this example, the applicator 3 is generally mushroom-shaped. The bearing surface 35 can thus have an annular shape.

The applicator 3 shown in FIG. 9 can, as illustrated, be formed with the cavity 12 and the latter extends, for example, at least partially into the recess 30 when the applicator 3 is in place on the container 2.

The bearing surface 35 can be formed by the first part 16.

To use the applicators 3 in the examples shown in FIGS. 1 to 9, the user can cool them by placing them in the freezer, thereby freezing the liquid L when it is present.

On removal from the freezer, the temperature of the application surface is, for example, between −6° C. and −8° C.

The container 2 holding the cosmetic composition P can be held at a temperature higher than that of the applicator 3, for example, being retained at ambient temperature outside the refrigerator.

The user can then take up the composition P from the container 2, for example, with a finger, and apply it on an area to be treated or on the applicator 3.

The applicator 3 can then be brought into contact with the area to be treated.

The applicator 3 can be used by being moved in contact with the skin, for example, by circular or straight movements, to impart, for example, a massaging action and/or to spread the composition P. The user can also proceed by applying pressure at a succession of points, without substantial movement of the applicator on the skin, to effect a cryopuncture treatment, for example. The applicator 3 can also touch the skin. The applicator 3 can also be used to impart an effect equivalent to cold ironing of the skin or of a substrate applied to the skin. The applicator 3 can be used to treat bags under the eyes.

Further, the applicator 3 can be used to take up the composition P from the container 2.

Figure 10:
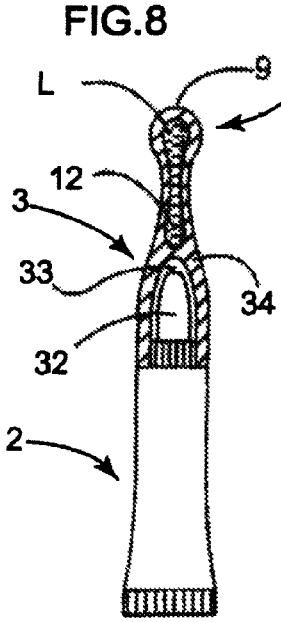
FIGS. 10 to 14 are schematic and partial longitudinal cross-sections of devices according to alternative embodiments of the invention.

FIG. 10 illustrates an example in which the container 2 takes the form of a tube that includes a dispensing nozzle closed off by a closure cap 32.

The applicator 3 in this example can be designed to be fixed on the closure cap 32 by means of a recess 33 formed in the body 34 of the applicator.

Retention of the applicator 3 on the cap 32 can be provided such as by friction or other means, for example, by snap attachment or screwing.

The body 34 can be made with the cavity 12 accommodating the liquid L, as illustrated.

To use the applicator 3 shown in FIG. 10, the user can separate it from the container 2 and place it in the refrigerator, for example. The user can then dispense the composition held in the container 2 onto the applicator 3 or onto the area to be treated. The user can use the body 34 as a grasping element without replacing the applicator 3 thereon, or as a variant, can use the applicator 3 after attaching it to the container 2, the latter then forming the grasping surface.

Figure 64:
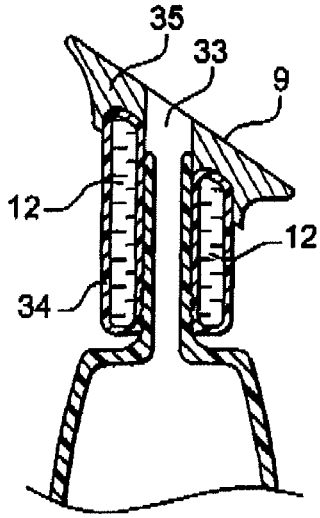

According to another example illustrated in FIG. 64, applicator 3 is, for example, arranged to be fixed directly on the dispensing nozzle of the tube by friction, thanks to a recess 33, which is in this example emerging so as to form a passage for the product. Body 34 of the applicator includes a cavity 12 around recess 33 so that, once the applicator is assembled on the tube, the cavity surrounds the dispensing nozzle. Body 34 of the applicator is surmounted by a metal head 35 which comes in contact with the skin when the product is dispensed.

Figure 11:
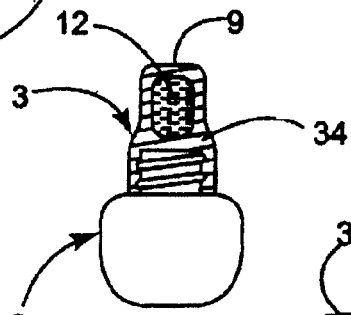

FIG. 11 depicts an alternative embodiment in which the container 2 is a bottle provided with a neck, and the body 34 serves as a closure cap by being screwed onto the neck.

Figure 12:
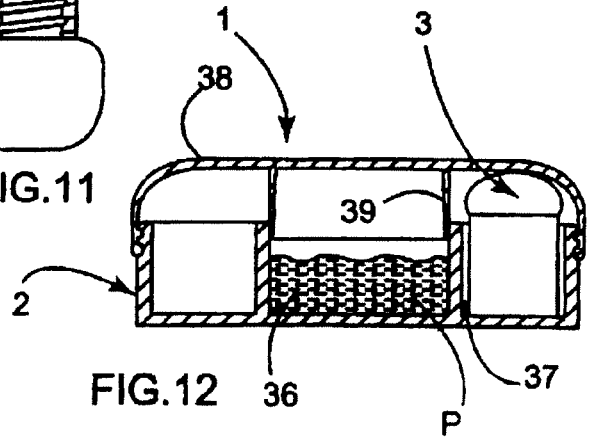

The composition P can also be held in a container 2 such as that illustrated in FIG. 12, which includes a first compartment 36 to receive the composition P and a second compartment 37 to receive the applicator 3.

In the example considered, these two compartments 36 and 37 are closed off by a common cover 38, which includes, for example, a sealing skirt 39 so as to close the first compartment 36 in a leaktight manner.

In the example shown in FIG. 12, the cover 38 is designed to screw on, but in variants not illustrated, the cover 38 is attached by other means such as, for example, by insertion or by a hinge on the container 2.

The second compartment 37 can contain several applicators 3 having different shapes and/or configured to be used differently, for example, by being cooled in at least one instance and heated in at least one other instance.

Figure 13:
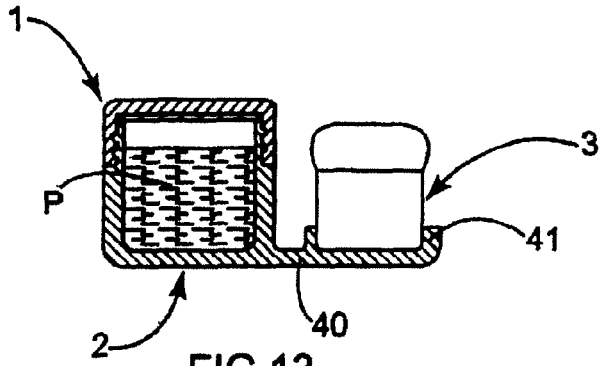

The composition P can, as illustrated in FIG. 13, be held in a container 2 incorporating an extension 40 designed to accommodate the applicator 3.

The extension 40 extends, for example, laterally and can include a recess 41 of a shape adapted to receive the applicator 3.

The composition P to be applied can be provided to the user together with at least two applicators 3, one being intended, for example, to be cooled and the other to be heated.

These two applicators 3 can be provided to the user in the form of a kit with the container 2 holding the composition P.

Figure 14:
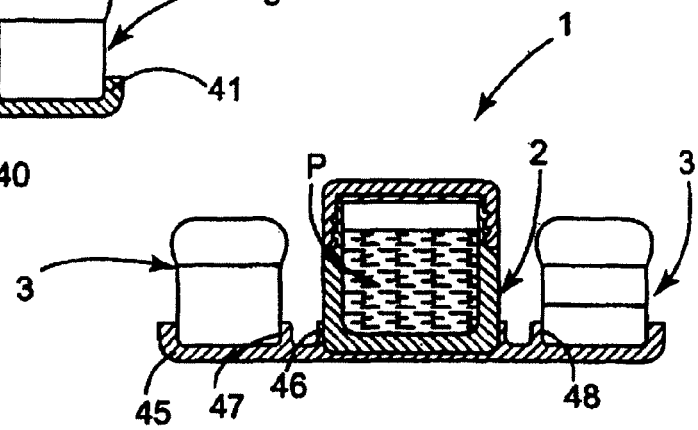

The kit includes, for example, a holder 45 capable of accommodating the container 2 and the applicators 3 when not in use, as illustrated in FIG. 14. The holder 45 can include, for example, a recess 46 to receive the container 2 holding the composition P and two recesses 47 and 48 each receiving an applicator 3.

In a variant not illustrated, the container 2 is made in one piece with the holder 45.

Figure 15:
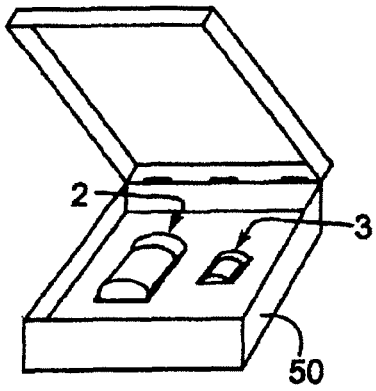
FIGS. 15 and 16 are schematic perspective illustrations of examples of kits for putting the invention into effect.

The container 2 can also be provided to the user with at least one applicator 3 in packaging such as a box 50, for example, as illustrated in FIG. 15.

The composition P can take the form of a powder, cream, paste, gel or liquid, or can impregnate and/or coat a substrate such as, for example, a woven material, a non-woven material, a foam or a felt.

Figure 17:
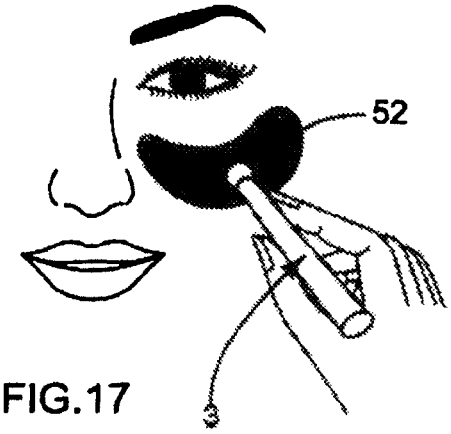
FIG. 17 illustrates the use of the kit in FIG. 16.

The substrate 52, in the form of a mask or a patch, for example, can be applied onto the skin, and the cooled applicator 3 is then brought into contact therewith, as illustrated in FIG. 17.

Figure 16:
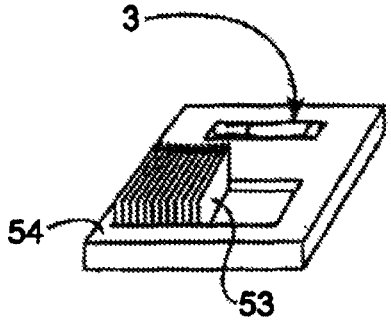

The substrate 52 can be contained in an individual pack 53 and be provided to the user in the form of a kit in conjunction with at least one applicator 3, the set being, for example, contained in a pack 54, as illustrated in FIG. 16.

In a variant not illustrated, a plurality of substrates can also be provided to the user, in a common package rather than in individual packaging.

The substrate impregnated with composition can optionally be substantially anhydrous and can be wettable by a solvent such as water, for example, at the time of use.

FIG. 18 depicts another example of a kit for putting the invention into effect. The applicator 3 includes a recess 60 intended to receive a substrate 62 containing the composition to be applied, or the composition itself in the form of a block shaped so that it is able to fit into the recess 60. The substrate 62 or the block of composition can be contained in an individual pack 64, for example. The quantity of composition contained in the substrate 62 or constituting the aforementioned block can correspond to a single use.

During use, the user typically removes the substrate 62 or the block of composition from the pack 64 and inserts it into the recess 60 of the applicator as shown in FIG. 19.

The depth of the recess 60 is, for example, smaller than that of substrate 62 so that the user can apply the composition onto the area to be treated.

The recess 60 is, for example, formed in a metallic part of the applicator 3 so as to promote heat exchange between the substrate 62 or the block of composition and the applicator 3.

Placement of the substrate 62 or block of composition on the applicator can be effected when the latter is cooled or heated.

After application, the substrate 62 can be withdrawn from the recess 60.

The applicator 3 can also be made in a variety of other ways.

The cavity 12, which contains the liquid L, can in particular be closed in different ways.

FIG. 20 depicts an embodiment in which the first 16 and second 14 parts cooperate by screwing and the second part 14 includes a sealing lip 70, which bears on a radially inner surface of the first part thereby closing the cavity 12 in a leaktight manner.

The second part 14 can include a threaded skirt 71, which partially covers the first part 16 and which defines the grasping surface 10.

In the alternative embodiment illustrated in FIG. 21, the first 16 and second 14 parts are assembled with the interposition of a leaktight seal 72.

The second part 14 is, for example, threaded on the side of the first part 16, which can be screwed onto the second part 14.

The applicator 3 can also include a body 76 defining the grasping surface 10 and the application surface 9, as illustrated in FIG. 22. The body can be recessed to define the cavity 12 filled with the liquid L.

The cavity 12 can be closed, for example, by means of a plug 78, which can be fixed on the body 76 by various means, being, for example, fixed thereon by snap attachment. The plug 78 can include an annular sealing lip 79 bearing on a surface of the body 76 delineating the cavity 12.

FIG. 60 depicts an alternative embodiment quite similar to that shown in FIG. 20. However, the second part 14 includes a skirt 71, which extends up to the wider portion of the first part. In addition, the thickness of the first part 16 between the cavity 12 and the application surface is smaller.

The applicator 3 shown in FIG. 23 differs from that depicted in FIG. 22 by the fact that the cavity 12 is closed by a bottom 80, which is, for example, welded to the body 76 around the opening used to fill the cavity 12. The bottom 80 is, for example, a sheet of a material impermeable to the liquid L, which can be transparent.

The applicator 3 can be made with a wide variety of external shapes, for example, an elongated shape with a widened head, as illustrated in FIG. 24.

The cavity 12 can extend over more or less of the height of the applicator.

In the example shown in FIG. 24, the cavity 12 extends over more than half of the length of the applicator 3, in this instance practically over the whole of its length.

In the embodiment depicted in FIG. 25, the applicator 3 has a rounded head.

This figure illustrates the possibility for the applicator to include an application surface 9 defined by a coating 300 covering a wall 301 delineating the cavity 12. The coating 300 is, for example, an elastomer membrane, a woven or a non-woven material.

Figure 26:
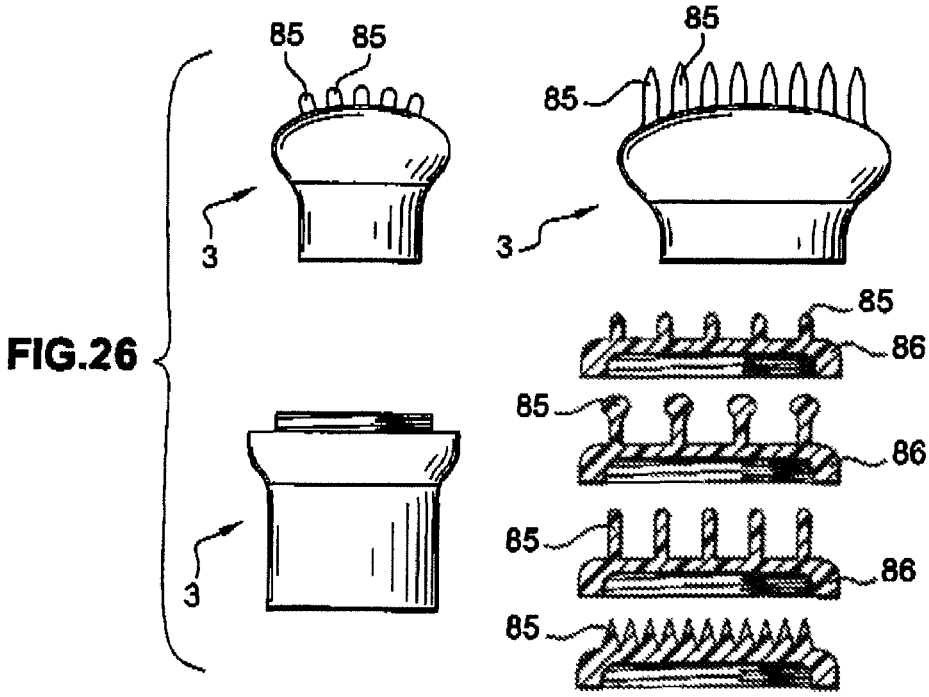
FIG. 26 illustrates alternative embodiments of the applicator.

The application surface 9 of the applicator 3 can include projections 85, for example, raised points as illustrated in FIG. 26.

The projections 85 can be made of an elastomer or metallic material, for example.

The projections 85 can modify the transfer of cold and their shapes can be chosen depending on the treatment to be effected.

The projections 85 can be formed on a detachable element 86, as illustrated, which makes it possible for the user to choose the projections 85 depending on the treatment to be effected. Attachment of the element 86 can be accomplished by screwing, for example.

The applicator 3 can include an application surface 9 having a flat portion as illustrated in FIG. 27, which can extend obliquely relative to the longitudinal axis X of the applicator 3, for example.

It can also be seen in FIG. 27 that the cavity 12 can include an opening enabling it to be filled with the liquid L, and this opening can be closed off by a plug 88 formed, for example, by a drop of glue.

Figure 62:
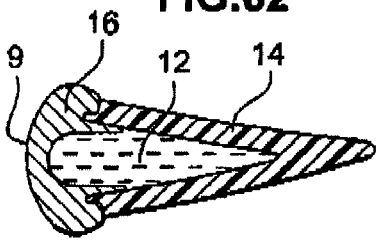

FIG. 28 depicts an applicator 3 which includes a first part 16 defining the cavity 12 filled with the liquid L and a second part 14 having the form of an elongate handle which may not be traversed by the cavity 12, as illustrated. In another example, the second part 14 is traversed by cavity 12 as illustrated in FIG. 62.

Figure 29:
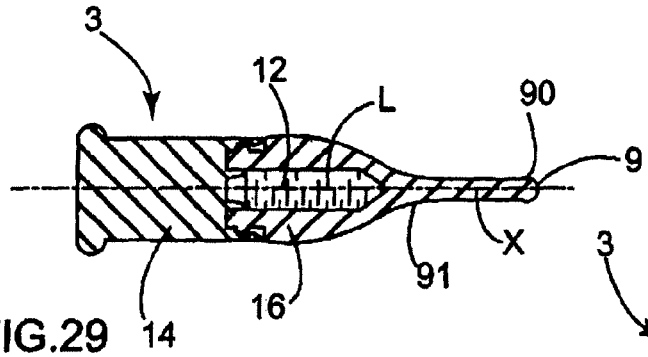

The application surface can also be defined by a head 90 which is connected to the rest of the applicator by a narrow portion 91 as illustrated in FIG. 29. In this Figure, the first part 16, which includes the narrow portion 91, is, for example, made of a metallic material. The narrow portion 91 can be flexible, and can bend during use.

The first part 16 is, for example, snapped into the second part 14, the cavity 12 being formed inside the first part 16 and closed off at one end by the second part 14.

Figure 31:
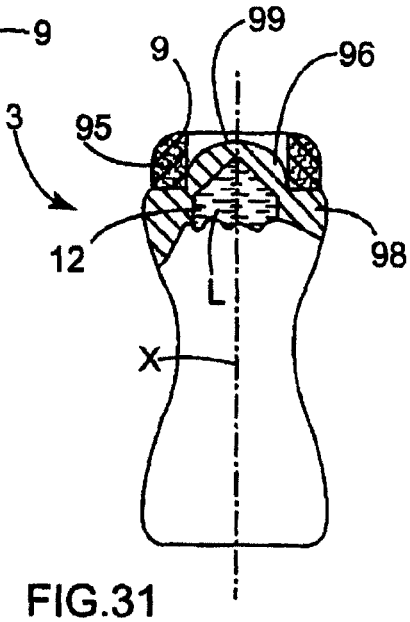
FIG. 31 is a partial longitudinal cross-section of the applicator in FIG. 30.
Figure 30:
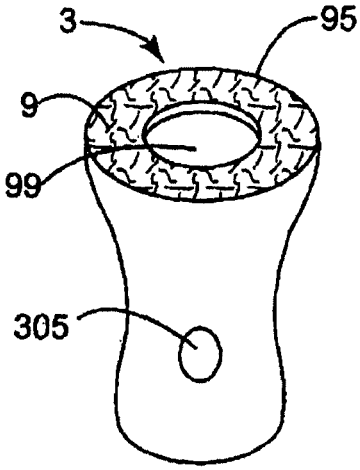
FIG. 30 is a schematic illustration, in perspective view, of another embodiment of the applicator.

The application surface 9 of the applicator 3 can be defined at least partially by a fitted part 95 made, for example, of a resiliently deformable material, for example, a foam, as depicted in FIGS. 30 and 31.

The fitted element 95 can have an annular shape and can be mounted on an extension 96 of the applicator body 98. The top 99 of the extension 96 can also serve as the application surface. The element 95 can be cleaned after it has been used.

FIG. 30 illustrates the possibility for the applicator 3 to include a temperature indicator 305, which can change colour and indicate to the user that the application surface 9 is at an acceptable temperature for the treatment to be affected.

Figure 32:
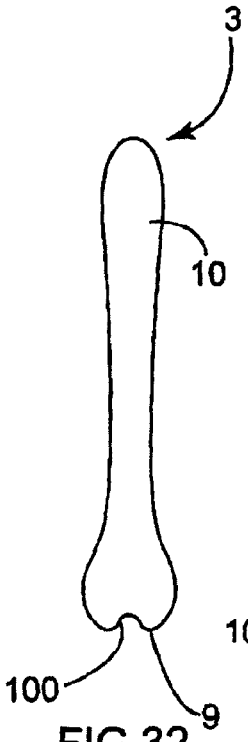
FIGS. 32 to 35 are elevation views of alternative embodiments of the applicator.
Figure 33:
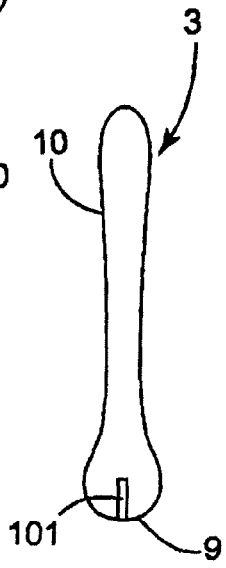

The application surface 9 can include, as can be seen in FIG. 32, at least one depression 100 allowing an accumulation of product, or a slot 101 as illustrated in FIG. 33.

Figure 34:
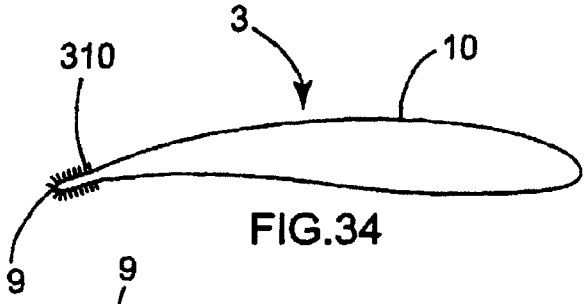
Figure 35:
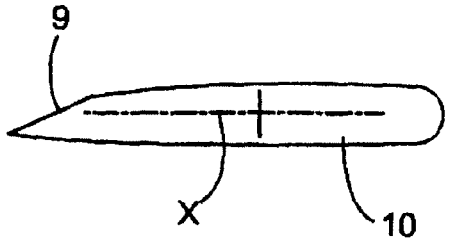

The application surface 9 can be defined at one end by a point, as illustrated in FIG. 34, or by a bevelled end face as illustrated in FIG. 35.

FIG. 34 also illustrates the possibility for the application surface 9 to include a flock covering 310.

The application surface 9 can also be defined, as illustrated in FIG. 36, by a mass 103 of a heat conducting material, fixed in a recess 104 of a first part 105 of the applicator 3. This first part can define the cavity 12 including the liquid L, and can be supported by a grasping part 106 made of a poorer heat-conducting material than that of the first part 105. The mass 103 is, for example, a ceramic, a glass, a dense stone or a metallic material.

FIG. 37 illustrates the possibility for the application surface 9 to be formed by a part 110 which is in direct contact with the liquid L contained in the cavity 12.

The part 110 is, for example, metallic and the cavity 12 is, for example, formed inside a body 111 made of insulating plastic.

A plug 112 can be screwed onto the body 111 to close the bottom of the cavity 12.

The applicator 3 can include two application surfaces 9 having different shapes, as illustrated in FIG. 38, for example, an application surface having a rounded shape and an application surface having a bevelled shape.

An insulating ring 118 can be provided in a median region of the applicator 3 to define the grasping surface 10.

The differently shaped application surfaces 9 are, for example, located at opposite ends of the applicator 3.

The latter can also include application surfaces 9 having different shapes or otherwise, located at the same side, as illustrated in FIG. 39.

The applicator 3 can, for example, be U-shaped, the ends of the U defining the application surfaces 9, and the base of the U defining the grasping surface 10.

The applicator 3 can be designed so that, when it is resting on a flat surface 5, as illustrated in FIG. 40, it allows the liquid L contained in the cavity 12 to come into contact with the wall 120 which defines the application surface 9.

Thermal contact is thus established between the liquid L and the wall 120, which is advantageous in particular when the liquid L changes state and becomes solid when taken to a sufficiently low temperature.

During use, the liquid L in the solid state can remain in contact with the wall 120 until it has melted.

The applicator 3 can be placed on a holder 130 when it is put into the freezer so that it is held upside down for the time required for freezing of the liquid L, as illustrated in FIG. 41.

Figure 42:
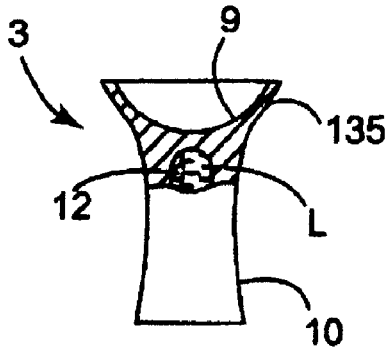

The applicator 3 can be at least partially resiliently deformable and the application surface 9 can be defined at least partially by a flexible lip 135 making it possible to create a suction cup effect, as illustrated in FIG. 42.

Figure 43:
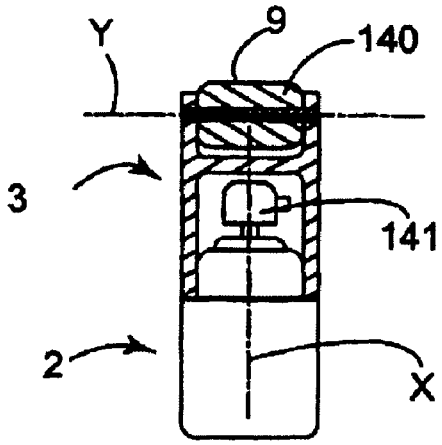

The application surface 9 can also be defined by a mobile member, in particular rotary, for example, a roller 140 as illustrated in FIG. 43, turning about an axis of rotation Y which is, for example, perpendicular to the longitudinal axis X.

This figure illustrates the possibility for the container 2 to be equipped with a dispensing device 141 such as a pump or a valve, for example, making it possible to dispense the composition onto the area to be treated or the application surface 9 before placing it in contact with the skin.

Figure 44:
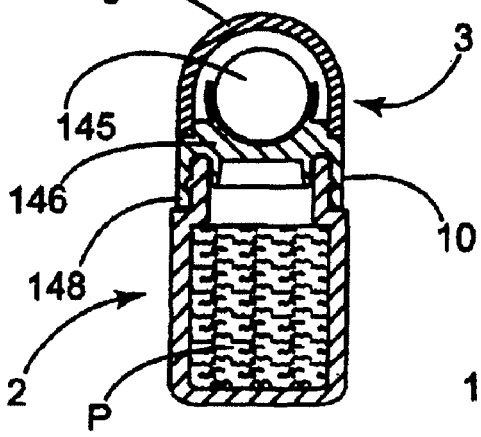

The application surface 9 can also be defined by a rotating member such as a ball 145, as illustrated in FIG. 44.

The ball can be carried by a holder 146 which can be detachably mounted on the container 2. Thus, the user can detach the holder 146 in order to cool it without exposing the composition P held in the container to the cold. Though not depicted, the ball can include a cavity and a liquid.

Once cooled, the holder 146 can be reattached to the container 2 and the container 2 used as a grasping element.

As a variant, a skirt 148 on the applicator 3 enables it to be attached on the container 2, which can define the grasping surface 10.

Figure 45:
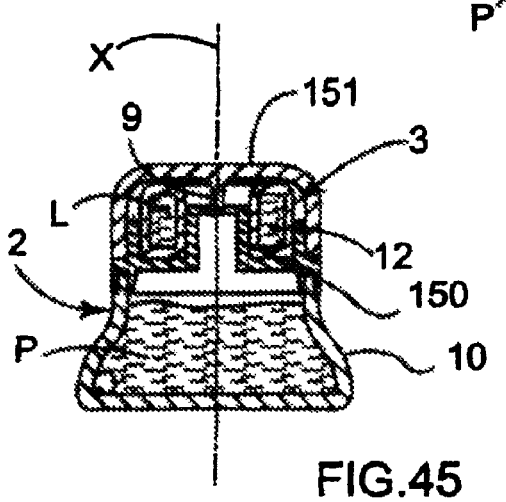

FIG. 45 depicts an alternative embodiment wherein the application surface 9 can be defined by an applicator 3 of generally annular shape configured to be placed around an upstand 150 on the container 2 wherethrough the composition P is dispensed.

A closure element 151 can be fitted on the container 2 to close off the upstand 150 when not in use. To use the applicator 3, the user detaches it from the container 2 and puts it in the freezer, for example.

Then, once cooled, the applicator 3 is refitted around the upstand 150 and the container 2 can be used as a grasping element to bring the application surface 9 into contact with the area to be treated.

Figure 46:
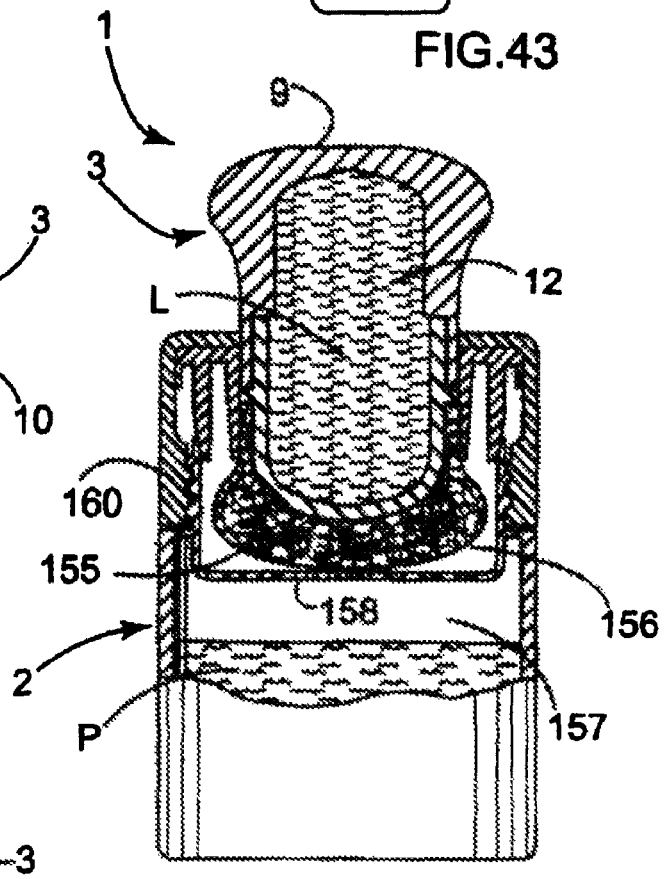

In the example shown in FIG. 46, the applicator 3 includes an application surface 9 intended to apply cold in the area to be treated and an element 155 for taking up the product held in the container 2.

This take-up element 155 is, for example, located on the applicator 3 on the side opposite the application surface 9.

The container 2 includes, for example, a recess 156 to receive the take-up element 155, this recess 156 being separated from a space 157 containing the composition P by a perforated wall 158 which limits the quantity with which the take-up element 155 can be loaded. The latter can be used to apply the composition P on the area to be treated.

The applicator 3 can be integral with a closure element 160 of the container 2, for example, designed to be screwed thereon.

To use the device 1 shown in FIG. 46, the user separates the applicator 3 from the container and places the latter in the refrigerator or freezer. The user then takes up the composition P from the recess 156, for example, after shaking the device 1 with the applicator 3 in place, and can apply the composition contained in and/or on the take-up element 155 by means of the latter. Once the composition has been applied, the user can turn the applicator 3 around and use the application surface 9 to apply cold.

In the example shown in FIG. 47, the application surface 9 is designed to come into contact with the product composition inside the container 2. The latter can include a wiper element 165 which makes it possible to remove any excess product that may be present on the applicator 3.

The applicator 3 can include projections 170 making it possible to increase the quantity of product with which the applicator is loaded and/or making it possible to impart greater flexibility to the applicator as it passes over the area to be treated.

The applicator 3 can be designed to be mounted on a dispensing device 175 such as a pump or valve, including a stem 176 which, when depressed and/or tilted, causes the composition to be dispensed, as seen in FIG. 48.

The applicator 3 can include an internal channel 177 enabling the product delivered by the stem 176 to reach the application surface 9.

In the example in FIG. 48, the applicator 3 includes a covering skirt 179 making it possible to conceal all or part of the dispensing device 175 and also defining a grasping surface for the user.

The device 1 shown in FIG. 48 is used by first separating the applicator 3 from the dispensing device 175 and then cooling the applicator 3 independently of the dispensing device 175.

The applicator 3 is then reattached to the dispensing device 175 and, by actuating the applicator 3, the user can cause product to be dispensed through the channel 177.

FIG. 49 illustrates a variant in which the dispensing device 175 includes a pump fed by an immersion tube 180.

In the example in shown FIG. 50, the applicator 3 can be screwed onto the neck of a container and presents, for example, an outwardly convex application surface 9 into the bottom of which emerges an aperture 183 for delivery of the composition P. The body 184 of the applicator can include an insert 186 intended to increase the thermal capacity of the applicator 3.

Irrespective of the shape of the applicator 3, it can be equipped with a vibrator 190, as illustrated in FIG. 51.

A vibrator 190 of this kind includes, for example, a motor 191 rotationally driving an offset weight 192 so as to produce vibrations. The motor 191 can be powered by one or more cells 193, optionally rechargeable.

The vibrator 190 is, for example, arranged to be detachably fixed on a part 195 of the applicator including the application surface 9, so as to enable the user to use the same vibrator with different application surfaces 9.

The applicator 3 can also include at least one electrode, for example, two electrodes 200 to electrically stimulate the treated area during the application. These electrodes are, for example, electrically connected to a cell 202 which defines the grasping surface 10.

The cavity 12 extends, for example, around the electrodes 200 which are configured to exchange heat with the liquid L contained in the cavity 12.

To use the applicator 3 shown in FIG. 52, the user can separate the applicator 3 from the cell 202 and place it in the refrigerator.

Once the desired temperature is reached, the user can reattach the applicator 3 to the cell 202 and use the cell 202 as a grasping element to bring the electrodes 200 into contact with the area to be treated. The cell 202 can apply cold to the area treated.

In a variant, the cell 202 is also cooled.

The applicator 3 can also have magnetic properties.

Figure 53:
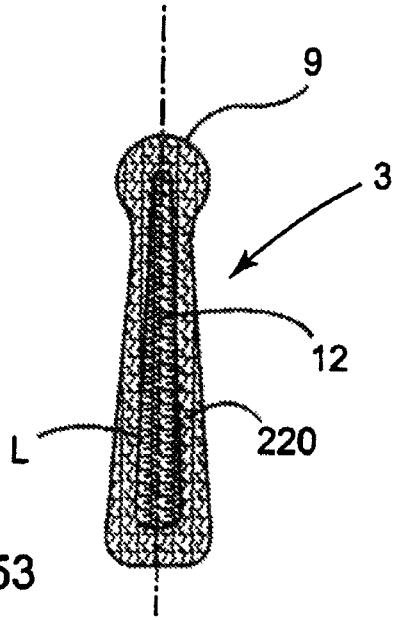

By way of example, FIG. 53 illustrates an applicator 3 which includes a body 220 charged with magnetic particles.

As in the example illustrated, the body 220 can also defme at least partially the cavity 12 containing the liquid L. The presence of a magnetic particle charge can increase the thermal capacity of the applicator 3.

Figure 63:
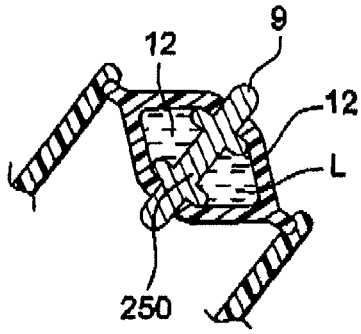

FIGS. 54, 55 and 63 illustrate a packaging and application device having an applicator 3 including two rollers 240 mounted on flexible rods 241 connected to a base 242 making it possible to render the applicator 3 integral with the container 2.

The latter includes, for example, at one end a screw thread 243 for attachment of the applicator 3 to the container 2 and at the opposite end a cover 244 serving to close off a dispensing aperture 245.

The rollers 240 are designed to provide the desired thermal capacity and can have cavities filled with the liquid L.

In the example illustrated in FIG. 63, the rollers consist of two parts made out of plastic which encase on both sides each one of a metal disc 250. Two cavities 12 containing liquid L are thus made on both sides of the disc. The edge of the disc defines an application surface 9. The cavities are delimited in their major part by a plastic wall.

In the variant illustrated in FIG. 56, the container 2 is equipped with a dispensing device 248 such as a pump or valve. The composition is, for example, held under pressure in the container 2.

As illustrated, the applicator 3 can include a protective cap 249 to protect the application surface 9 when not in use.

Figure 57:
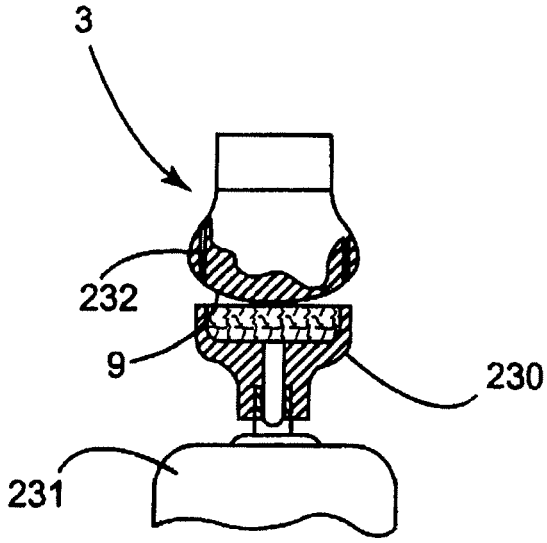
Figure 59:
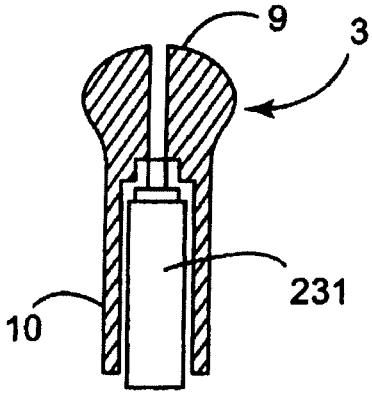
Figure 58:
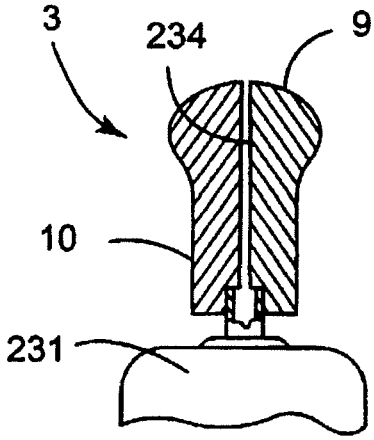

In the variants illustrated in FIGS. 57 to 59, cooling of the applicator 3 is effected by expansion of a compressed or liquefied gas.

In the example shown in FIG. 57, the application surface 9 is brought into contact with a porous block 230 which is exposed to expansion of gas fed from an aerosol container 231. The applicator 3 can include channels 232 enabling the expanded gas to circulate through the applicator 3 and thereby increase the rate of cooling thereof.

In the example shown in FIG. 58, the expansion of the compressed or liquefied gas takes place through the applicator 3, the latter including, for example, an internal channel 234 for the circulation of the expanded cold gas.

The aerosol container 231 can be accommodated at least partially inside the applicator 3, as illustrated in FIG. 59.

The invention is not limited to the examples described hereinbefore. It is possible in particular to combine the particular features of the various embodiments illustrated. It is possible, for example, to equip any one of the applicators described with a vibrator.

Throughout the description and claims, expressions such as "including one", "having one", "has one", or "comprises one" should be regarded as synonymous with "including at least one", unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States:

1. A device, comprising:

a composition held in a container or a substrate, wherein the composition is a cosmetic or dermatological composition; and an applicator configured to apply the composition, the applicator including a closed cavity which contains a liquid compound that is different from the cosmetic or dermatological composition held in the container or the substrate, and an application surface that includes an application surface material with at least one of a thermal inertia of at least 1,000 $Jm^{-2}K^{-1}s^{-1/2}$, and a thermal conductivity greater than or equal to 1 $Wm^{-1}K^{-1}$, wherein the applicator and the container or the substrate are contained in a common packaging device.

2. The device according to claim 1, wherein the application surface material has a thermal inertia of at least 5,000 $Jm^{-2}K^{-1}s^{-1/2}$.

3. The device according to claim 1, wherein the application surface material has a thermal inertia of at least 10,000 $Jm^{-2}K^{-1}s^{-1/2}$.

4. The device according to claim 1, wherein the application surface material has a thermal inertia of at least 20,000 $Jm^{-2}K^{-1}s^{-1/2}$.

5. The device according to claim 1, wherein the application surface material has a thermal conductivity greater than or equal to 40 $Wm^{-1}K^{-1}$.

6. The device according to claim 1, wherein the application surface material has a thermal conductivity greater than or equal to 180 $Wm^{-1}K^{-1}$.

7. The device according to claim 1, wherein the application surface material has a volume density greater than or equal to 1.5 $g/cm^3$.

8. The device according to claim 7, wherein the application surface material is a metal, stone or glass.

9. The device according to claim 1, wherein the applicator includes a material of specific heat capacity greater than or equal to 500 $J\,kg^{-1}K^{-1}$.

10. The device according to claim 1, wherein the applicator includes a material of specific heat capacity greater than or equal to 1,000 $J\,kg^{-1}K^{-1}$.

11. The device according to claim 1, wherein the applicator includes a material of specific heat capacity greater than or equal to 2,000 $J\,kg^{-1}K^{-1}$.

12. The device according to claim 1, wherein the applicator has a mass greater than or equal to 15 g.

13. The device according to claim 1, wherein the applicator includes a grasping surface that includes a material with a thermal conductivity less than or equal to 1 $Wm^{-1}K^{-1}$.

14. The device according to claim 1, wherein the applicator includes a grasping surface that includes a material with a thermal conductivity less than or equal to 0.5 $Wm^{-1}K^{-1}$.

15. The device according to claim 1, wherein the applicator includes a grasping surface that includes a material with a thermal conductivity less than or equal to 0.1 $Wm^{-1}K^{-1}$.

16. The device according to claim 1, wherein the application surface includes at least one region that extends between 3 and 10 $cm^2$ and is configured to wholly contact the skin, and wherein a thermal capacity of the applicator is greater than or equal to 250 $J\,K^{-1}$ at a temperature of 15° C.

17. The device according to claim 1, wherein the application surface includes at least one region that extends between 0.1 and 3 $cm^2$ and is configured to wholly contact the skin, and wherein a thermal capacity of the applicator is greater than or equal to 50 $J\,K^{-1}$ at a temperature of 15° C.

18. The device according to claim 1, wherein the applicator is configured to be detachably fixed on the container.

19. The device according to claim 18, wherein the applicator is configured to be detachably fixed on a closure element of the container.

20. The device according to claim 18, wherein the applicator includes a passage enabling the composition to be dispensed when the applicator is mounted on the container.

21. The device according to claim 1, wherein the substrate is configured to be detachably fixed on the applicator.

22. The device according to claim 1, wherein the applicator includes a rotary applicator element configured to contact an area to be treated.

23. The device according to claim 1, wherein the applicator is at least partially magnetic.

24. A device, comprising:

a composition held in a container or a substrate; and an applicator configured to apply the composition, the applicator including an application surface that includes an application surface material with at least one of a thermal inertia of at least 1,000 $Jm^{-2}K^{-1}s^{-1/2}$, and a thermal conductivity greater than or equal to 1 $Wm^{-1}K^{-1}$, wherein the applicator and the container or the substrate are contained in a common packaging device, and wherein the applicator includes a flexible lip configured to contact an area to be treated.

25. The device according to claim 1, wherein the applicator includes a vibrator.

26. A device, comprising:

a composition held in a container or a substrate; and an applicator configured to apply the composition, the applicator including an application surface that includes an application surface material with at least one of a thermal inertia of at least 1,000 $Jm^{-2}K^{-1}s^{-1/2}$, and a thermal conductivity greater than or equal to 1 $Wm^{-1}K^{-1}$, wherein the applicator and the container or the substrate are contained in a common packaging device, and wherein the applicator includes an electrode connected to an electrical power source.

27. The device according to claim 1, wherein the applicator has no electrical power source or means of connection to an electrical power source.

28. The device according to claim 1, wherein the applicator is configured to retain, for at least 30 seconds, a temperature below or equal to 15° C. when the applicator is cooled to −8° C. and applied on an area to be treated.

29. The device according to claim 1, wherein the applicator is configured to retain, for at least 1 minute, a temperature below or equal to 15° C. when the applicator is cooled to −8° C. and applied on an area to be treated.

30. The device according to claim 1, wherein the applicator is configured to retain, for at least 15 minutes, a temperature below or equal to 15° C. when the applicator is cooled to −8° C. and applied on an area to be treated.

31. The device according to claim 1, wherein the applicator is configured to retain, for at least 30 minutes, a temperature below or equal to 15° C. when the applicator is cooled to −8° C. and applied on an area to be treated.

32. The device according to claim 1, wherein the applicator does not include any compounds that react together by an endothermic reaction.

33. The device according to claim 1, wherein the application surface is at least partially covered by an elastomer membrane, a foam material, a flock material, a plastic film, a sponge material, a felt material, a woven material or non-woven material.

34. The device according to claim 1, wherein the application surface includes a detachable element.

35. The device according to claim 34, wherein the detachable element includes an absorbent material.

36. The device according to claim 1, wherein the compound is in contact with a wall delimiting the application surface when the device is in a storage position.

37. The device according to claim 1, wherein the compound changes state when cooled from ambient temperature to a temperature not below −18° C.

38. The device according to claim 1, wherein the compound includes water.

39. The device according to claim 1, wherein the cavity includes at least 0.2 $cm^3$ of liquid.

40. The device according to claim 1, wherein the cavity includes between 1 and 80 $cm^3$ of liquid.

41. A device, comprising:

a composition held in a container or a substrate; and an applicator configured to apply the composition, the applicator including an application surface that includes an application surface material with at least one of a thermal inertia of at least 1,000 $Jm^{-2}K^{-1}s^{-1/2}$, and a thermal conductivity greater than or equal to 1 $Wm^{-1}K^{-1}$, wherein the applicator and the container or the substrate are contained in a common packaging device, wherein the applicator includes a cavity, wherein the cavity is partially defined by a first material with a thermal conductivity greater than or equal to 1 $Wm^{-1}K^{-1}$, and is partially defined by a second material with a thermal conductivity less than or equal to 1 $Wm^{-1}K^{-1}$.

42. The device according to claim 41, wherein the cavity is partially defined by a metallic material and is partially defined by a plastic material.

43. The device according to claim 41, wherein most of the cavity is partially defined by the second material with a thermal conductivity less than or equal to 1 $Wm^{-1}K^{-1}$.

44. The device according claim 1, wherein the applicator includes a wall between the cavity and the application surface.

45. The device according to claim 44, wherein the wall has a thickness less than or equal to 50 mm.

46. The device according to claim 44, wherein the wall has a thickness between 0.1 mm and 50 mm.

47. The device according to claim 44, wherein the wall has a thickness less than or equal to 1 mm.

48. The device according to claim 44, wherein the wall has a thickness less than or equal to 0.5 mm.

49. An applicator, comprising:

an application surface including a material with a thermal conductivity greater than or equal to 1 $Wm^{-1}K^{-1}$;

a grasping surface including a material with a thermal conductivity less than or equal to 1 $Wm^{-1}K^{-1}$; and a cavity inside the applicator containing a liquid, wherein the cavity is partially defined by a first material with a thermal conductivity greater than or equal to 1 $Wm^{-1}K^{-1}$, and partially defined by a second material with a thermal conductivity less than or equal to 1 $Wm^{-1}K^{-1}$.

50. The applicator according to claim 49, wherein the cavity contains at least 0.2 ml of the liquid.

51. The applicator according to claim 49, wherein more of the cavity is defined by the second material than the first material.

52. The applicator according to claim 49, wherein the cavity is defined by a wall with a non-constant thickness.

53. The applicator according to claim 49, wherein the application surface includes a material with a thermal conductivity greater than or equal to 40 $Wm^{-1}K^{-1}$.

54. The applicator according to claim 49, wherein the application surface includes a material with a thermal conductivity greater than or equal to 180 $Wm^{-1}K^{-1}$.

55. The applicator according to claim 49, wherein the grasping surface includes a material with a thermal conductivity less than or equal to 0.5 $Wm^{-1}K^{-1}$.

56. The applicator according to claim 49, wherein the grasping surface includes a material with a thermal conductivity less than or equal to 0.1 $Wm^{-1}K^{-1}$.

57. The applicator according to claim 49, wherein the liquid changes state when the applicator is cooled to a temperature of −18° C.

58. The applicator according to claim 57, wherein the cavity contains at least 5 ml of the liquid.

59. The applicator according to claim 49, wherein the application and grasping surfaces are respectively defined by a first part and a second part assembled one on the other.

60. The applicator according to claim 49, further comprising a wall between the cavity and the application surface that has a thickness less than or equal to 50 mm.

61. The applicator according to claim 60, wherein the wall between the cavity and the application surface has a thickness between 0.1 mm and 50 mm.

62. The applicator according to claim 60, wherein the wall between the cavity and the application surface has a thickness less than or equal to 1 mm.

63. The applicator according to claim 60, wherein the wall between the cavity and the application surface has a thickness less than or equal to 0.5 mm.

64. An applicator, comprising:

an application surface including a material with a thermal conductivity greater than or equal to 1 $Wm^{-1}K^{-1}$;

a grasping surface including a material with a thermal conductivity less than or equal to 1 $Wm^{-1}K^{-1}$; and a cavity inside the applicator containing a liquid, wherein the cavity is partially defined by a metallic material and partially defined by plastic material.

65. The applicator according to claim 49, wherein the liquid is in contact with a wall delimiting the application surface when the applicator is in a storage position.

66. The applicator according to claim 49, wherein the application surface is at least partially covered by an elastomer membrane, a foam material, a flock material, a plastic film, a sponge material, a felt material, a woven material or non-woven material.

67. The applicator according to claim 49, wherein an internal surface of a wall delimiting the cavity is covered with a varnish.

68. A device, comprising:

a composition held in a container that includes a body that extends along a longitudinal axis of the container from a base of the container to a top surface of the container; and an applicator configured to apply the composition, the applicator including an internal cavity that contains a compound in a leaktight manner, the internal cavity being defined by a first part and a second part, the first part including an application surface that extends substantially transverse to the longitudinal axis, and the second part including a grasping surface that extends along the longitudinal axis between a lower face of the applicator and the application surface, the lower face being a flat surface that extends substantially transverse to the longitudinal axis, the application surface including an application surface material with at least one of a thermal inertia of at least 1,000 $Jm^{-2}K^{-1}s^{-1/2}$, and a thermal conductivity greater than or equal to 1 $Wm^{-1}K^{-1}$, wherein the applicator is detachably mounted on the container.

69. The device according to claim 68, wherein the container includes a recess that opens at the top surface and extends along the longitudinal axis, and wherein the recess includes a bottom wall that extends substantially transverse to the longitudinal axis and a side wall that extends along the longitudinal axis.

70. The device according to claim 69, wherein the applicator is received within the recess of the container such that the lower face of the applicator directly contacts the bottom wall of the recess, and a portion the grasping surface of the applicator makes face to face contact with the side wall of the recess.

* * * * *